US007009563B2

(12) United States Patent
Mori et al.

(10) Patent No.: US 7,009,563 B2
(45) Date of Patent: Mar. 7, 2006

(54) ANTENNA, METHOD AND CONSTRUCTION OF MOUNTING THEREOF, AND ELECTRONIC DEVICE HAVING ANTENNA

(75) Inventors: Shinichiro Mori, Kawasaki (JP); Hitoshi Yamasaki, Kawasaki (JP); Shin Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/766,963

(22) Filed: Jan. 30, 2004

(65) Prior Publication Data

US 2004/0212536 A1 Oct. 28, 2004

(30) Foreign Application Priority Data

Feb. 5, 2003 (JP) ..... 2003-028902
Aug. 6, 2003 (JP) ..... 2003-287783

(51) Int. Cl.
*H01Q 1/38* (2006.01)

(52) U.S. Cl. ..... 343/700 MS; 343/702

(58) Field of Classification Search ..... 343/700 MS, 343/702, 895, 846, 850, 853
See application file for complete search history.

(56) References Cited

U.S. PATENT DOCUMENTS 5,003,318 A * 3/1991 Berneking et al. ... 343/700 MS
5,635,942 A 6/1997 Kushihi et al. ..... 343/700 MS
5,831,578 A 11/1998 Lefevre ..... 343/700 MS
6,388,623 B1 * 5/2002 Sakota et al. ..... 343/700 MS
6,556,169 B1 * 4/2003 Fukuura et al. ..... 343/700 MS
6,674,405 B1 * 1/2004 Wang ..... 343/700 MS
6,825,809 B1 * 11/2004 Aoki et al. ..... 343/700 MS
2003/0020657 A1 * 1/2003 Sakamoto et al. ... 343/700 MS

FOREIGN PATENT DOCUMENTS

EP 1 096 601 5/2001
EP 1 193 795 4/2002
JP 9-1999940 7/1997
JP 2000-49526 2/2000

* cited by examiner

*Primary Examiner*—Hoang V. Nguyen
(74) *Attorney, Agent, or Firm*—Staas & Halsey LLP

(57) ABSTRACT

A plane antenna of the present invention gives the realization of a surface mounting construction on a circuit base board, the enlargement of a mounting area for components, and the improvement of an SN ratio by avoiding the influence of a noise from a back face side of the mounting base board. The plane antenna mounted on the circuit base board has a dielectric substrate and a junction conductor, and realizes the surface mounting construction. The dielectric substrate is provided on the circuit base board, and an antenna pattern part is mounted on the dielectric substrate. To a feeding point of the antenna pattern part one end portion of the junction conductor is connected, and its the other end portion is connected to a feeding conductor of the circuit base board at a side of a mounting face of the antenna element of the circuit base board. According to a construction like this, the surface mounting construction on the circuit base board is realized.

30 Claims, 35 Drawing Sheets

ANTENNA, METHOD AND CONSTRUCTION OF MOUNTING THEREOF, AND ELECTRONIC DEVICE HAVING ANTENNA

BACKGROUND OF THE INVENTION

1. Field of the Invention

The present invention relates to an antenna which is used for a radio communication device such as GPS (Global Positioning System) using a frequency band over UHF (Ultra High Frequency), and mounting of the antenna. Along with a surface mounting construction of the antenna, the present invention relates to an antenna element which realizes the improvement of mounting efficiency of mounted components, a mounting method of the antenna element, a plane antenna, and a circuit base board and an electronic device having the plane antenna.

2. Description of the Related Art

Recently, as a mobile communication terminal device, a device which uses a plurality of radio communication methods in one terminal device is becoming widespread. In this case, if each communication method uses different radio communication frequency, it is necessary to provide a plurality of antennas. For example, in a mobile phone unit having a GPS function which receives an electric wave from a satellite and can obtain the information of a present position, since the frequency of a GPS signal is 1.57 GHz, this is different from 800 MHz zone and 2 GHz zone which are frequency bands used by a domestic mobile phone unit in Japan. Because of this, an exclusive antenna for GPS is mounted in addition to an antenna for the mobile phone unit. In this case, when installing a wireless LAN function such as short distance radio communication of 2.4 GHz zone in ISM band, it is necessary to mount an exclusive antenna.

Further, a mobile phone unit and so on is directed to higher development of functions, for example, the embarkation of a digital camera and the addition of a high-speed CPU for the improvement of high-speed processing of software. In addition to this, for example, a liquid crystal display is made bigger. By these, the number of components is increasing and the density of mounted components is becoming higher. Hence, these give restriction to the mounting of a radio communication antenna.

By the way, if a structural element has resonated with a predetermined frequency, the gain of an antenna is improved in proportion as its physical shape becomes larger, and an electrical characteristic of the antenna becomes advantageous. Therefore, when giving precedence to performance, its shape must be made larger. Because of this, in case that an antenna is mounted in a mobile phone unit, a trade-off between a restricted mounting space and an antenna performance satisfying the system gain of a radio communication system is performed. However, since an antenna with predetermined gain is required in order to obtain the minimum system gain, its shape and dimension are naturally decided.

In a GPS antenna receiving a satellite electric wave, since the increment in a receiving level has influence on positioning accuracy, its gain had better be higher. Further, the satellite electric wave is a circularly polarized wave method, and the plane antenna for a circularly polarized wave is required in order to receive its electric wave with higher efficiency.

For example, in a car navigation system, an antenna having a shape of 25 mm square is used. On the other hand, as an antenna for a mobile phone unit use, an antenna of 13 mm square is developed. This shortens electrical length by increasing the specific inductive capacity of a dielectric part and making GPS frequency resonate, and thereby a physical shape is made smaller. However, in this case, its gain falls by a dielectric loss. In case that a miniaturized exclusive antenna for GPS is mounted in a mobile phone unit, since its shape and measure are larger as compared with other parts, a mounting space for the antenna is needed. Obtaining an antenna mounting space like this becomes a cause leading to a fall of an article power in commerce because of an obstructive factor of miniaturization of a mobile phone unit, a restriction of a design of an appearance, and so on.

Like this, in a communication device having an exclusive antenna corresponding to a plurality of radio communication methods, the maintenance of radio communication performance, the improvement of mounting efficiency by means of the improvement of high density of components mounted on a device, the improvement of a multi-function and the miniaturization of a device are requested.

Further, a plane antenna is also called a patch antenna or a micro-strip antenna, and is widely used as a receiving antenna of GPS and so on. For example, a conventional plane antenna has a shape shown in FIG. 1 and FIG. 2. FIG. 1 shows a plan view of the plane antenna, and FIG. 2 shows a sectional view taken along line II—II of FIG. 1. In this plane antenna, for example, a circular antenna pattern part 4 is provided on an upper face of a rectangular dielectric substrate 2, and thereby an antenna element 6 is constructed. A junction conductor 10 is connected to a feeding point 8 of the antenna pattern part 4 by solder 12, and the junction conductor 10 is passed through an inside of the antenna element 6 and is protruded like a pin shape from a back face of the dielectric substrate 2. In a printed circuit base board 14 for mounting the antenna element 6, a ground pattern part 16 is provided, and a through hole 18 is also formed at a position at which the antenna element 6 is arranged. Further, the junction conductor 10 is provided through the through hole 18 of the printed circuit base board 14, and a transmission line 20 as a feeding line is electrically connected to a pointed end portion of the junction conductor 10, which protrudes to the back face side of the printed circuit base board 14, by solder 22. A reference numeral 24 is a connected portion of the junction conductor 10 and the transmission line 20 by means of the solder 22.

Further, FIG. 3 is an outline view showing a conventional GPS receiving module having the plane antenna from an upper face side thereof. On the printed circuit base board 14 as a circuit base board of this GPS receiving module 26, a plane antenna 28, a down converter part 30 which frequency-converts a GPS signal from RF frequency to intermediate frequency (IF), and a position computation signal output terminal part 32 which outputs position information to an outside of the GPS receiving module 26 are mounted.

FIG. 4 is a sectional view taken along line IV—IV of FIG. 3, and FIG. 5 is an outline view showing the GPS receiving module 26 from a back face side thereof. For this GPS receiving module 26, a component mounting part is formed inside a shielding cover 34 which is provided to the back space side of the printed circuit base board 14, and a GPS signal operation processing part 36 performing position computing operation by the signal processing of IF signal and a clock signal generation part 38 are provided therein.

In order to make it possible to receive the electromagnetic wave of a circularly polarized wave with high efficiency as a GPS antenna, the plane antenna 28 is a patch antenna in which the patch-shaped antenna element 6 is formed on a plane. For the plane antenna 28, the antenna pattern part 4 is formed on the dielectric substrate 2 as a surface electrode which is formed on the surface of dielectric by metalizing a conductive material serving as a structural element resonating with predetermined frequency. A circularly polarized wave is composed by making two polarized waves meet at right angles and forming vertically-polarized wave component and horizontally-polarized wave component. The antenna pattern part 4 which is a patch antenna electrode resonates with $\lambda/2$ (at this, $\lambda$: wave length) in a longitudinal direction. Because of this, if a power source is supplied to a center of the square electrode, in the plane antenna 28 shown in FIG. 3, electromagnetic waves are excited in a longitudinal direction and a transversal direction, and the signal of a circularly polarized wave can be received by the electromagnetic waves meeting at right angles being composed at resonance frequency.

This plane antenna 28 is constructed by the dielectric substrate 2, the antenna pattern part 4 composed of a metalized electrode, and the junction conductor 10 which is a feeding pin, and the antenna becomes a finished product of the plane antenna 28 by connecting between the antenna pattern part 4 and the junction conductor 10 by the solder 12. As described before, by the dielectric substrate 2 and the antenna pattern part 4, the antenna element 6 is constructed.

A mounting construction and method of this plane antenna 28 are explained by referring to FIG. 3 to FIG. 5. In the printed circuit base board 14, a hole piercing to its surface and back face is formed near the center of a portion mounting the plane antenna 28, the plane antenna 28 is constructed by unifying the dielectric substrate 2 and the junction conductor 10, and the junction conductor 10 of the plane antenna 28 is passed through the hole of the printed circuit base board 14. Further, as shown in FIG. 5, a feed connection land 40 existing at the back face of the printed circuit base board 14 and the junction conductor 10 are connected by solder 42. By this, a GPS received signal is led to the down converter part 30 through the transmission line 20 serving as a RF signal transmission line, a down converter part connection land 44 and a down converter part connection through hole 46.

The down converter part 30 performs frequency conversion from the GPS signal (frequency 1575.42 MHz) to the IF signal of 1–100 MHz, and performs position computation through operation processing of the received GPS signal by using the signal processing of a DSP (Digital Signal Processor) in the GPS signal operation processing part 36. And an output result of that position computation is output from the position computation signal output terminal part 32. An output signal given to the position computation signal output terminal part 32 is utilized for the confirmation of position information obtained by the GPS signal. For example, the output signal is given to another device not shown in the drawings and is used for the display of a computed result, or the output signal is transmitted to a personal computer not shown in the drawings and is used for plotting on a map.

As prior patent documents of a plane antenna like this, there are the Japanese Patent Laid Open Publications No. 2000-49526, No. 9-199940 and so on.

The Publication No. 2000-49526 relates to a plane antenna, and discloses that, in order to prevent the generated gas at the time of soldering from being confined in an electrode part and to make stable and firm mounting possible, a groove for leading the gas to an outside is formed in the side of a mounting face of a dielectric substrate.

Further, the Publication No. 9-199940 relates to an electronic circuit device having a plane antenna, and discloses that the plane antenna is provided on a printed circuit base board of the electronic circuit device.

By the way, in case of mounting the plane antenna 28 of a construction like this, as shown in FIG. 6 and FIG. 7, since the plane antenna 28 has a construction in which the junction conductor 10 piercing the dielectric substrate 2 protrudes from a bottom face of the dielectric substrate 2, the junction conductor 10 piercing a hole made in the printed circuit base board 14 on which the plane antenna 28 is provided must be connected to the feed connection land 40 existing on a face opposite to a face on which the antenna is mounted. For example, when setting all over the back face side of the plane antenna 28 to ground potential (GND) against the antenna pattern part 4, the antenna pattern part 4 is set to the shape and dimension resonating with the frequency of 1.57 GHz. In this case, feed must be performed at a center of the antenna pattern part 4. For feeding at the center, a pin for supplying a signal in a vertical direction from a surface portion of the antenna pattern part 4, namely the junction conductor 10 must be provided. In a construction having the junction conductor 10 mentioned above, as shown in FIG. 5, in order to take out a received signal from the junction conductor 10, the junction conductor 10 and the transmission line 20 of the printed circuit base board 14 are connected by punching a hole in the printed circuit base board 14 at a face opposite to a face having the antenna. In a mounting construction like this, since a connecting terminal of the junction conductor 10 occupies a component mounting part of the printed circuit base board 14, other components can not be provided in a circumferential portion of the feed connection land 40 to which the junction conductor 10 is connected.

Because of this, in case of mounting the plane antenna 28 on a printed circuit base board of a mobile phone unit, a part of a face opposite to a mounting face is occupied by the feed connection land 40, and moreover, the junction conductor 10 piercing the printed circuit base board protrudes to a back face side of the printed circuit base board and becomes a protruding portion. Because of this, there is a problem that these prevent other components from mounting.

That is, in a receiving device in which the plane antenna 28 is provided, in order to lead a signal received by the antenna pattern part 4 to a low-noise amplifier and a down converter circuit, the transmission line 20 is provided in the back face side of the printed circuit base board 14, and this transmission line 20 and the junction conductor 10 protruding to the back face side of the printed circuit base board 14 are connected by the solder 22 (FIG. 2). Because of this, on the rear face side of the printed circuit base board 14 to which the connected portion 24 and the transmission line 20 are exposed, mounting other components and arranging a component closely to the printed circuit base board 14 becomes difficult. Hence, there is an inconvenience that the mounting of the plane antenna 28 and the arrangement of components are restricted.

In case that the printed circuit base board 14 is thin, the junction conductor 10 protrudes to the back face side of the printed circuit base board 14, and, if this protruding length is long, the mounting of components and so on which adhere closely to the back face of the printed circuit base board 14 becomes impossible. Because of this, the mounting efficiency of components to the printed circuit base board 14 is to lower. Further, in the mounting construction in which the junction conductor 10 is made to pierce, it is necessary to form the through hole 18 in the printed circuit base board 14, and a pattern design considering the through hole 18 also becomes necessary in respect to the printed circuit base board 14.

Further, since the connected portion (the solder 12) of the side of the feeding point 8 and the connected portion 24 (the solder 22) of the side of the transmission line 20 exist respectively on different faces of the printed circuit base board 14, there is an inconvenience that these connections must be treated with separate processes. Furthermore, in a shape having the junction conductor 10 and its connected potion 24 exposed to the back face side of the printed circuit base board 14 through the ground pattern part 16, there is an inconvenience that noise strength is low because of being liable to accept the influence of a noise from the back face of the printed circuit base board 14 toward the feeding point 8 and so on.

The mounting construction of a plane antenna toward a circuit base board for a mobile phone is explained by referring to FIG. 8. FIG. 8 is a side view showing the mounting construction of the plane antenna of the mobile phone circuit base board. On this mobile phone circuit base board 48, a key input part 50, which is an information input part, and an information display part 52 are provided. The plane antenna 28 has a construction in which the junction conductor 10 protrudes from the bottom face of the dielectric substrate 2. Because of this, in the mobile phone circuit base board 48 on which this plane antenna 28 is mounted, other components must be provided so as to avoid the junction conductor 10 protruding from a back face of that base board, and besides, a feed connection land for connecting to the junction conductor 10 is required, for example. Hence, these become a cause making amounting area for components of the mobile phone circuit base board 48 enlarge.

In the printed circuit base board having the plane antenna as mentioned above, the connected portion of the plane antenna occupies up to the mounting region of its back face side, that prevents the printed circuit base board from the improvement of its reduction, and the fall of mounting density of components and the fall of mounting efficiency occur. As a result, these become a cause preventing a device having the plane antenna, such as a mobile phone, from its miniaturization.

The problems mentioned above are not disclosed in the Publications No. 2000-49526 and No. 9-199940, and can not be solved even if technology disclosed in these patent documents is used.

SUMMARY OF THE INVENTION

The present invention relates to a plane antenna, and an object of the present invention is to realize a surface mounting construction on a circuit base board.

Further, the present invention relates to a plane antenna, and another object of the present invention is to enlarge a mounting area for components.

Furthermore, the present invention relates to a plane antenna, and still another object of the present invention is to avoid the influence of a noise from a back face side of a circuit base board and to improve an SN ratio.

In order to attain the objects mentioned above, an antenna element of the present invention is antenna elements 138A and 138B mounted on a circuit base board (a printed circuit baseboard 108), and a surface mounting construction is realized by a construction having a dielectric substrate 100 and a junction conductor 114. That is, the dielectric substrate has an antenna pattern part 102, and the junction conductor pierces the dielectric substrate and its one end is connected to a feeding point 116 of the antenna pattern part. Further, the other end of the junction conductor is connected to a feeding conductor (a feeding pattern part 120) of the circuit base board at a face side of the circuit base board on which the antenna element is mounted.

According to a construction mentioned above, since the junction conductor does not pierce the circuit base board, the junction conductor neither pierces to a back face side of the circuit base board nor protrudes to the back face side of the circuit base board. Because of this, a connection between the junction conductor piercing the dielectric substrate and the feeding conductor is to be performed at an upper face side of the circuit base board. By this, a connection at a back face side of the circuit base board is dissolved, and, along with this, the dielectric substrate adheres closely to an antenna mounting face of the circuit base board and is provided thereto. Hence, the surface mounting construction is realized at only one face side of the circuit base board. That is, by realization of the surface mounting construction, the degrees of freedom in the mounting of an antenna element are heightened, and the enlargement of a mounting area for components is given.

In order to attain the objects mentioned above, the dielectric substrate may also be constructed so as to provide a space portion 134 which makes the junction conductor and the feeding conductor of the side of the circuit base board connect. According to a construction like this, it is possible to connect the junction conductor and the feeding conductor of the circuit base board side at the space portion.

In order to attain the objects mentioned above, the dielectric substrate may also be constructed so as to set the feeding point 116 of the antenna pattern part at a recess portion 184 of the dielectric substrate and so as to connect the junction conductor piercing the dielectric substrate to the feeding point of the antenna pattern part at an inside of the recess portion.

According to a construction like this, since a connection between the antenna pattern part and the junction conductor is performed at an inside of the recess portion formed in the dielectric substrate, its connected portion can be set within an upper face of the dielectric substrate, and the protrusion of the connected portion is prevented.

In order to attain the objects mentioned above, the dielectric substrate may also be constructed so that a through hole 128 corresponding to the feeding point of the antenna pattern part and a recess portion 132 formed at an opening portion of the through hole correspondingly to the space portion are provided, and, so that the junction conductor, one end portion being connected to the feeding conductor, and being stood on the circuit base board, pierces the through hole of the dielectric substrate and is connected to the feeding point of the antenna pattern part. According to a construction like this, the junction conductor is stood on the circuit base board, and the antenna pattern part and the feeding conductor can be connected above the circuit base board. Because of this, a surface mounting construction at one surface side of the circuit base board can be realized, and the degrees of freedom in the mounting of an antenna element and the mounting area for components in a rear face side of the circuit base board will be enlarged.

In order to attain the objects mentioned above, the dielectric substrate may also be constructed so as to provide a through hole 128 corresponding to the feeding point of the antenna pattern part, a recess portion 132 formed at an opening portion of the through hole correspondingly to the space portion, and the junction conductor, piercing the through hole, its one end portion being connected to the feeding point of the antenna pattern part, and its the other end portion protruding in the recess portion. According to a construction like this, the junction conductor of the side of the dielectric substrate is to be stood on the circuit base board. Hence, the antenna pattern part and the feeding conductor are connected on the circuit base board likewise, and a surface mounting construction at one face side of the circuit base board can be realized. Because of this, the degrees of freedom in the mounting of an antenna element and the mounting area for components in a rear face side of the circuit base board will be enlarged.

In order to attain the objects mentioned above, the junction conductor may also be constructed so as to provide a pillar portion 124 which is pierced to the through hole of the dielectric substrate and is connected to the feeding point of the antenna pattern part, and a flange portion 126 formed in this pillar portion. According to a construction like this, the flange portion makes a contribution to the enlargement of an area connected with the feeding conductor of the circuit base.

In order to attain the objects mentioned above, the pillar portion may also be constructed so as to be set more thinly than the thickness of the flange portion. According to a construction like this, sudden stress at the time of an impact given by a fall and so on can be absorbed by the thin pillar portion, and thereby stress given to a connected portion of the junction conductor will be reduced.

Further, in order to attain the objects mentioned above, the antenna element may also be constructed so as to fix between the circuit base board and the dielectric substrate by an elastically adhesive material, and the elastically adhesive material may also be constructed by a resin tape having adhesive layers at its both faces. Further, the flange portion may also be constructed so as to be set larger than the through hole of the dielectric substrate and smaller than a recess portion formed at the opening portion of the through hole.

Further, in order to attain the objects mentioned above, a mounting method of an antenna element according to the present invention has a construction which comprises a process that forms an antenna element, in a dielectric substrate, providing an antenna pattern part and a through hole corresponding to a feeding point of the antenna pattern part, a process that connects one end portion of a junction conductor to a feeding conductor and stands the junction conductor on a circuit base board, and a process that makes the junction conductor pierce to the through hole of the antenna element and also connects a pointed end portion of the junction conductor to the feeding point of the antenna pattern part.

Furthermore, in order to attain the objects mentioned above, a mounting method of an antenna element according to the present invention may also have a construction which comprises a process that forms an antenna element, in a dielectric substrate, providing an antenna pattern part, a through hole corresponding to a feeding point of the antenna pattern part, and a junction conductor, piercing the through hole, one end portion being connected to the feeding point of the antenna pattern part, and its the other end portion being protruded in an opening portion of the through hole, and a process that installs the antenna element on a circuit base board and connects the other end portion of the junction conductor to a feeding conductor of the circuit base board, In order to attain the objects mentioned above, a plane antenna according to the present invention is a plane antenna providing the above-mentioned antenna element, and has a circuit base board (a printed circuit base board 108) providing a first ground pattern part 110, a dielectric substrate 100, an antenna pattern part 102, a junction conductor 114, a feeding conductor (a feeding pattern part 120) and a second ground pattern part 140 (148 and 152). That is, the first ground pattern part is provided on the circuit base board, and the dielectric substrate is provided on this first ground pattern part. The antenna pattern part is formed on this dielectric substrate. One end portion of the junction conductor is connected to a feeding point of this antenna pattern part. The other end portion of the junction conductor pierces the dielectric substrate and is provided therein, and is made to protrude in a space portion formed between the dielectric substrate and the circuit base board. The feeding conductor is led to the space portion from an inner layer portion of the circuit base board, and is connected to the other end portion of the junction conductor. Further, the second ground pattern part is provided in a lower face side of this feeding conductor.

According to a construction like this, since a connection between the junction conductor piercing the dielectric substrate and the feeding conductor can be performed at an upper face side of the circuit base board, a connection at a back face side of the circuit base board is dissolved. That is, by realization of a surface mounting construction, the enlargement of a mounting area for components becomes possible without having restriction on mounting of the plane antenna. Along with this, since shielding effect is obtained by providing the second ground pattern part, the influence of a noise from the back face side of a mounting base board is avoided, and an SN ratio is improved.

Further, in order to attain the objects mentioned above, the plane antenna may also be constructed so as to fix the dielectric substrate on the circuit base board by an elastically adhesive material, and the elastically adhesive material may also be constructed by a resin tape having adhesive layers at its both faces. Further, the plane antenna may also be constructed so that a ground pattern part is provided on an upper face of the circuit base board, and an insulating substrate or a shielding plate having a ground pattern part is provided at a rear face side of the circuit base board.

In order to attain the objects mentioned above, a circuit base board of the present invention is a circuit base board (a printed circuit base board 108) on which a plane antenna 114 having an antenna pattern part 102 on a dielectric substrate 100 is mounted, and comprises a junction conductor 114 providing a flange portion 126, a through hole 128 formed in the dielectric substrate for making the junction conductor pierce, a recess portion 132 formed at an opening portion of the circuit base board side of this through hole to house the flange potion of the junction conductor. Further, the junction conductor which is attached on the circuit base board in advance pierces the through hole of the dielectric substrate so that the flange portion is housed in the recess portion of the dielectric substrate, its pointed end portion is connected to the antenna pattern part, and the dielectric substrate and the circuit base board are installed with close adhesion.

According to a construction like this, the junction conductor is mounted on the circuit base board. After that, the dielectric substrate in which the through hole is previously formed for making the junction conductor pierce is mounted on the circuit base board with close adhesion so that the junction conductor on the circuit base board is inserted into the through hole. Further, the junction conductor pierced to the dielectric substrate is connected to the antenna pattern part on the dielectric substrate. The flange portion of the junction conductor is housed in the recess portion of the dielectric substrate, and thereby the physical interference between the flange portion and the dielectric substrate is avoided.

In order to attain the objects mentioned above, an electronic device according to the present invention is a construction that has the above-mentioned antenna element, and the above-mentioned plane antenna or the above-mentioned circuit base board on which the above-mentioned plane antenna is mounted. According to a construction like this, by the realization of a surface mounting construction of a plane antenna, surface mounting becomes possible and a mounting area for components is enlarged, or the influence of a noise from a back face side of a circuit base board is avoided and a SN ratio will be improved.

Like this, since the present invention can mount a plane antenna at one face side of a circuit base board, the present invention makes a contribution to the enlargement of a mounting area of a circuit base board and the miniaturization of a device having a plane antenna, and can be widely used in many kinds of communication devices and is useful.

BRIEF DESCRIPTION OF THE DRAWINGS

The foregoing and other objects, features and attendant advantages of the present invention will be appreciated as the same become better understood by means of the following description and accompanying drawings wherein.

DETAILED DESCRIPTION OF THE INVENTION (First Embodiment)

Figure 1:
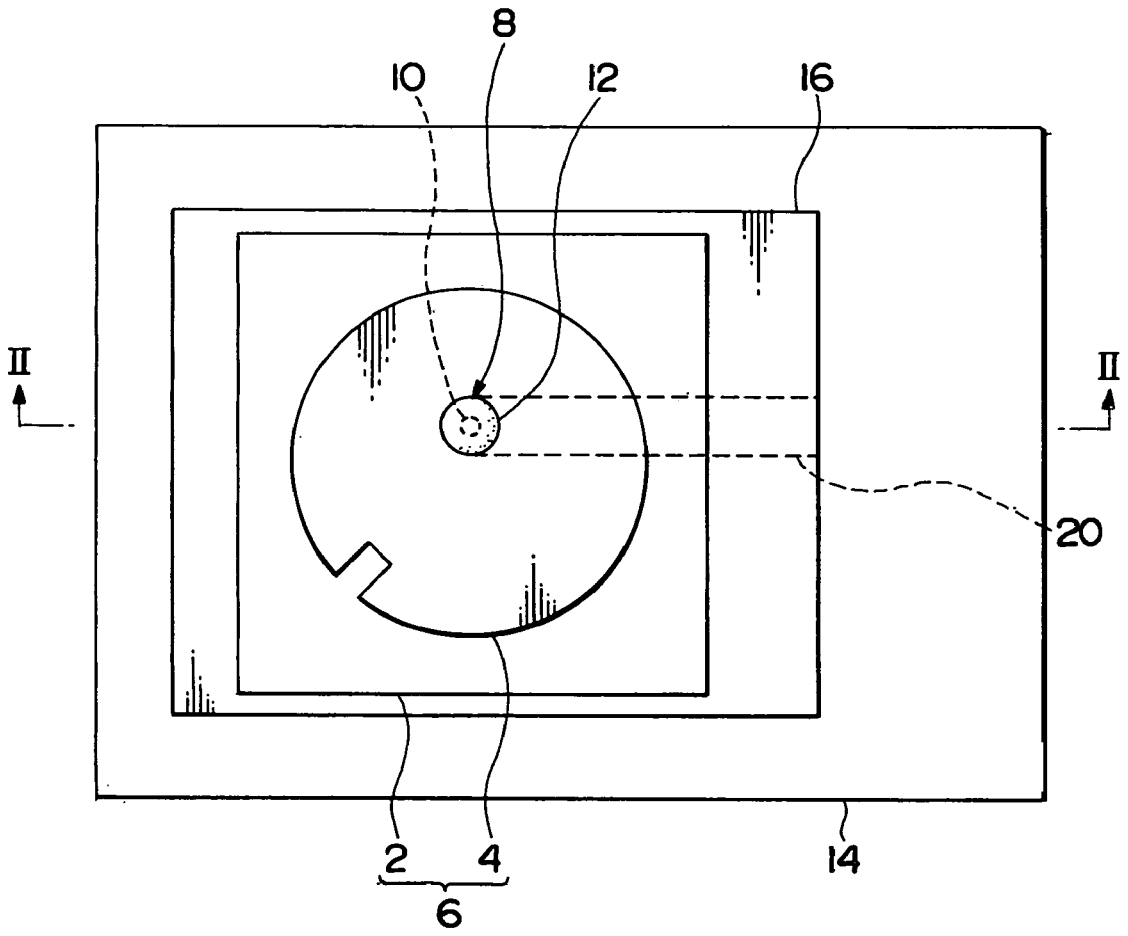
FIG. 1 is a plan view showing a prior plane antenna.
Figure 2:
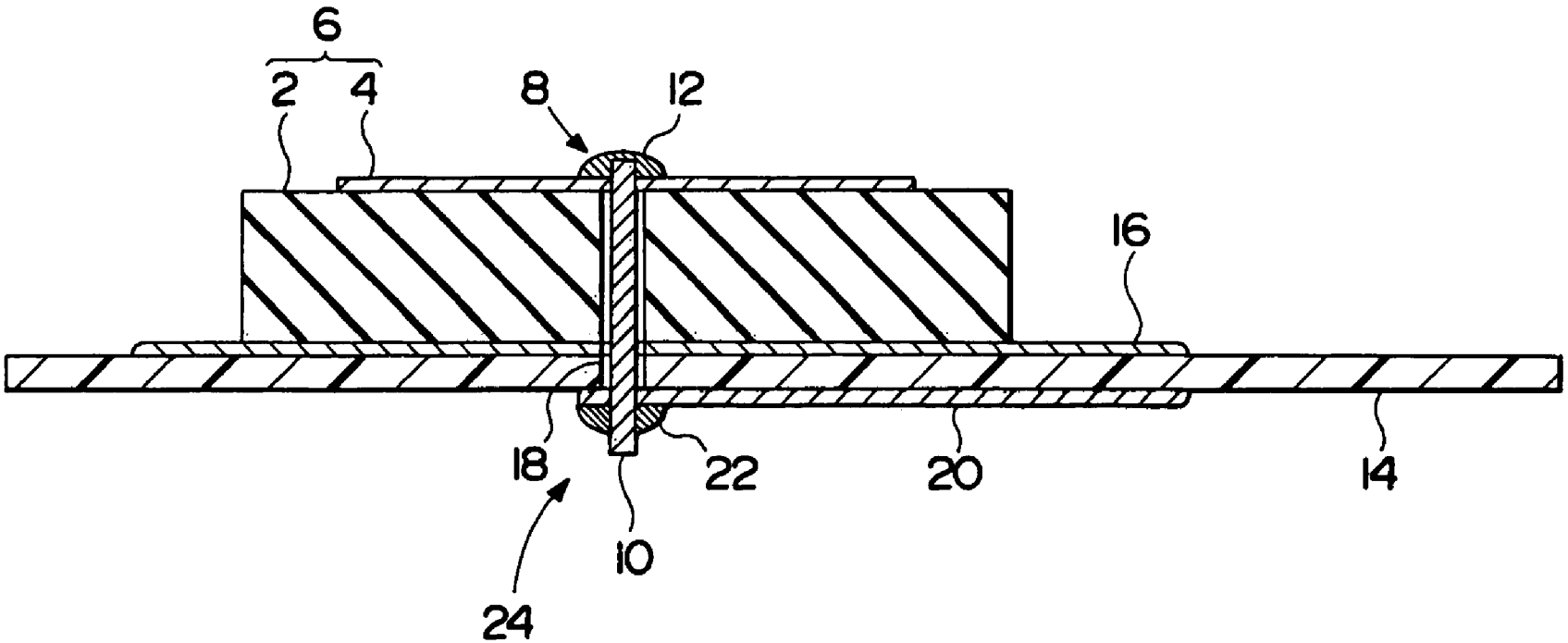
FIG. 2 is a sectional view taken along line II—II of the plane antenna shown in FIG. 1.
Figure 3:
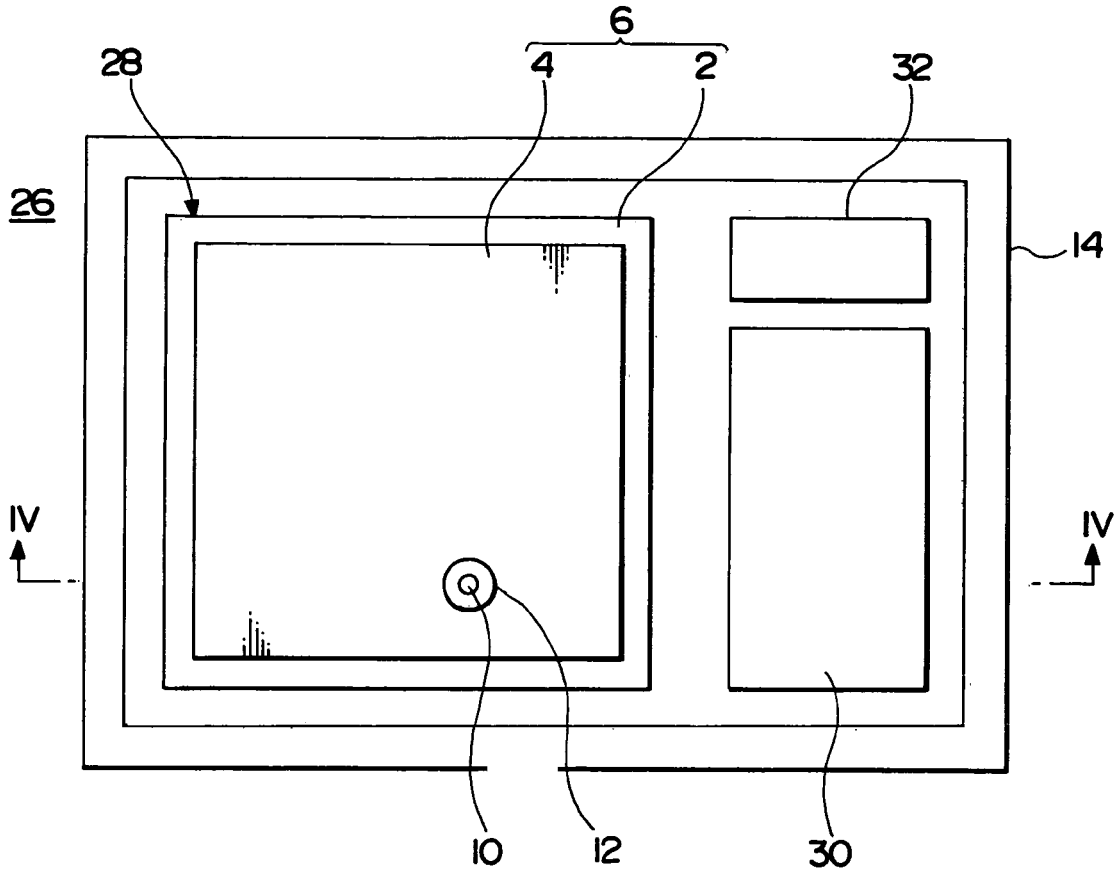
FIG. 3 is an outline view showing a prior GPS receiving module from its upper face side.
Figure 4:
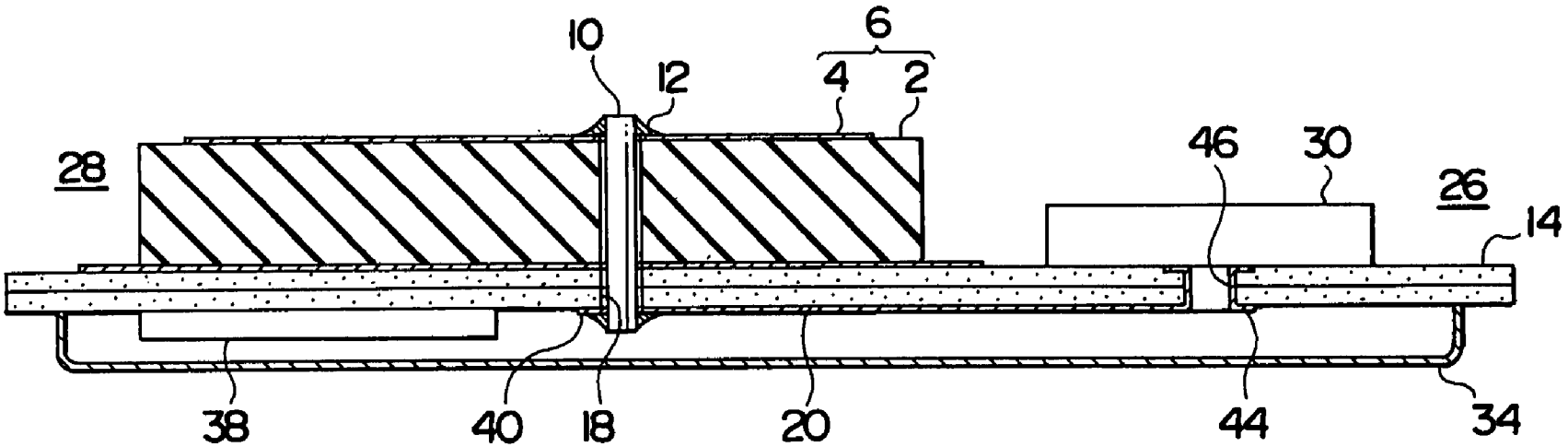
FIG. 4 is a sectional view taken along line IV—IV of the GPS receiving module shown in FIG. 3.
Figure 5:
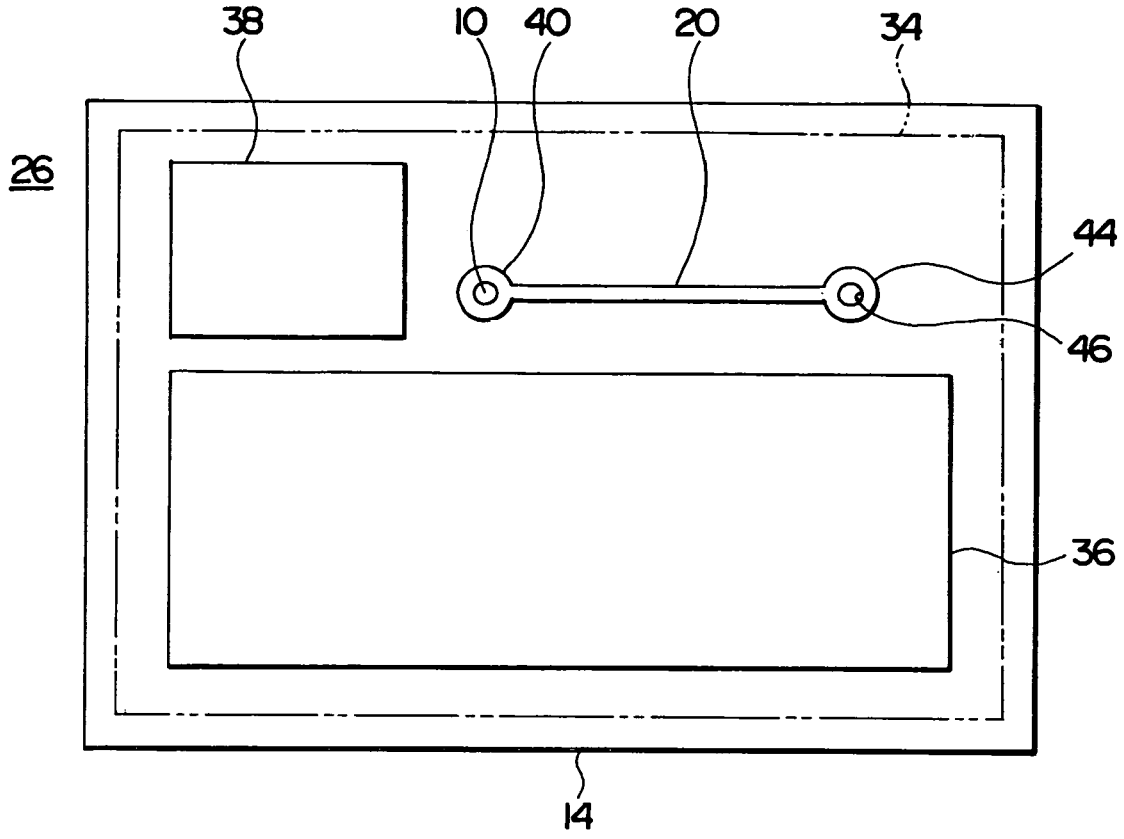
FIG. 5 is an outline view showing a prior GPS receiving module from its back face side.
Figure 6:
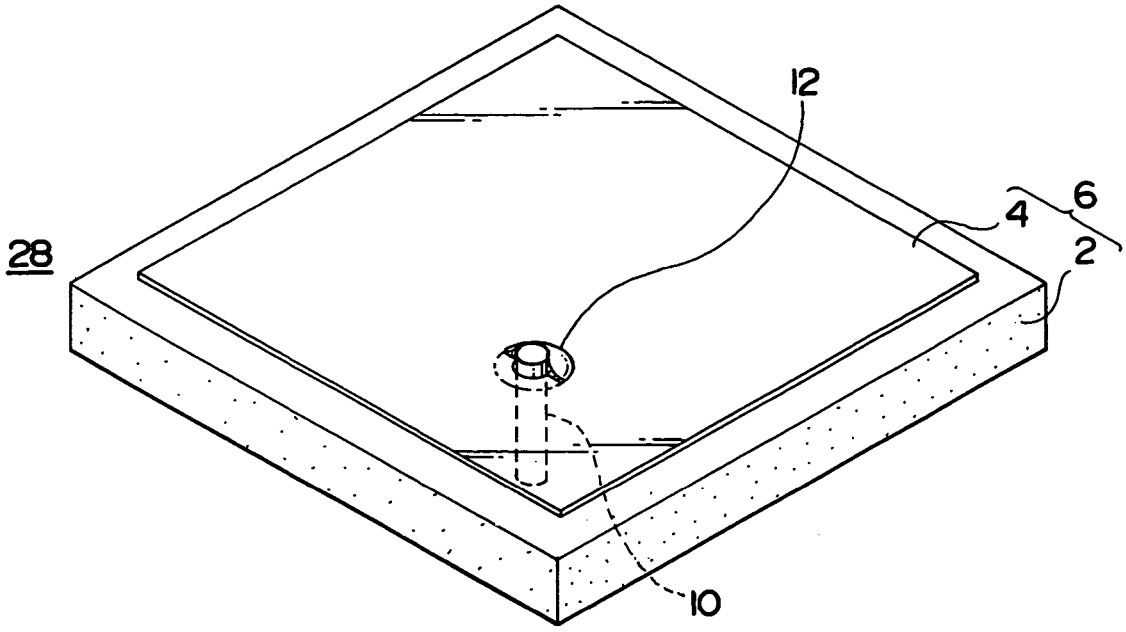
FIG. 6 is a perspective view showing a prior plane antenna.
Figure 7:
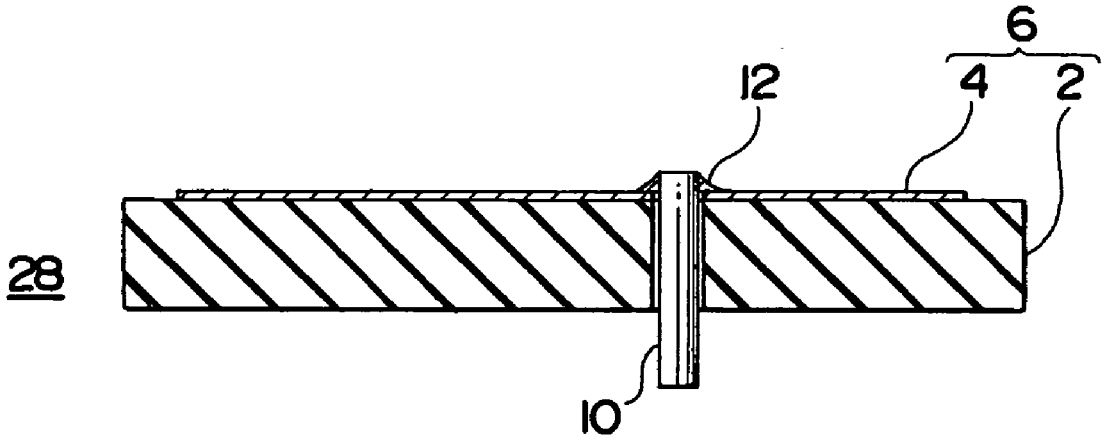
FIG. 7 is a sectional view showing a prior plane antenna.
Figure 8:
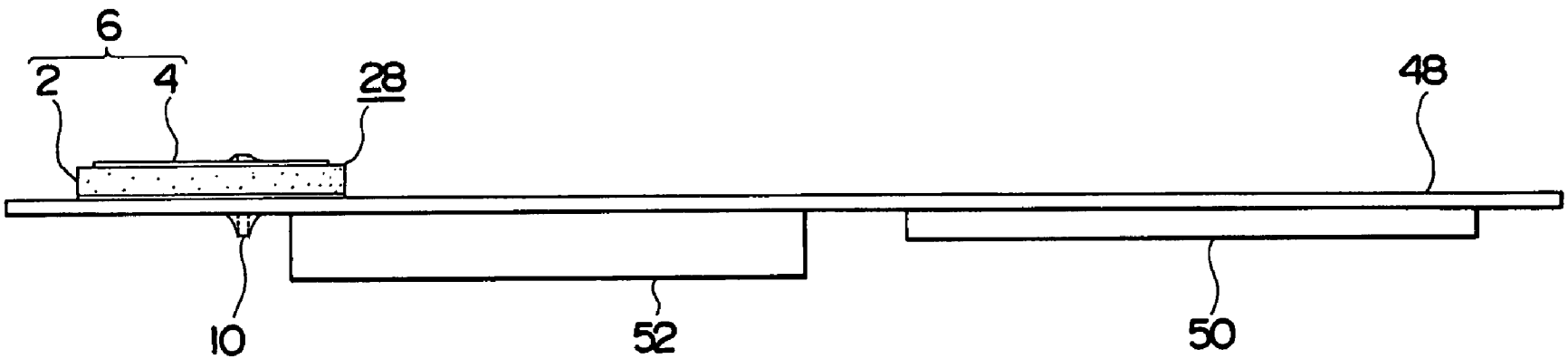
FIG. 8 is a sectional side view showing a prior GPS receiving module.
Figure 9:
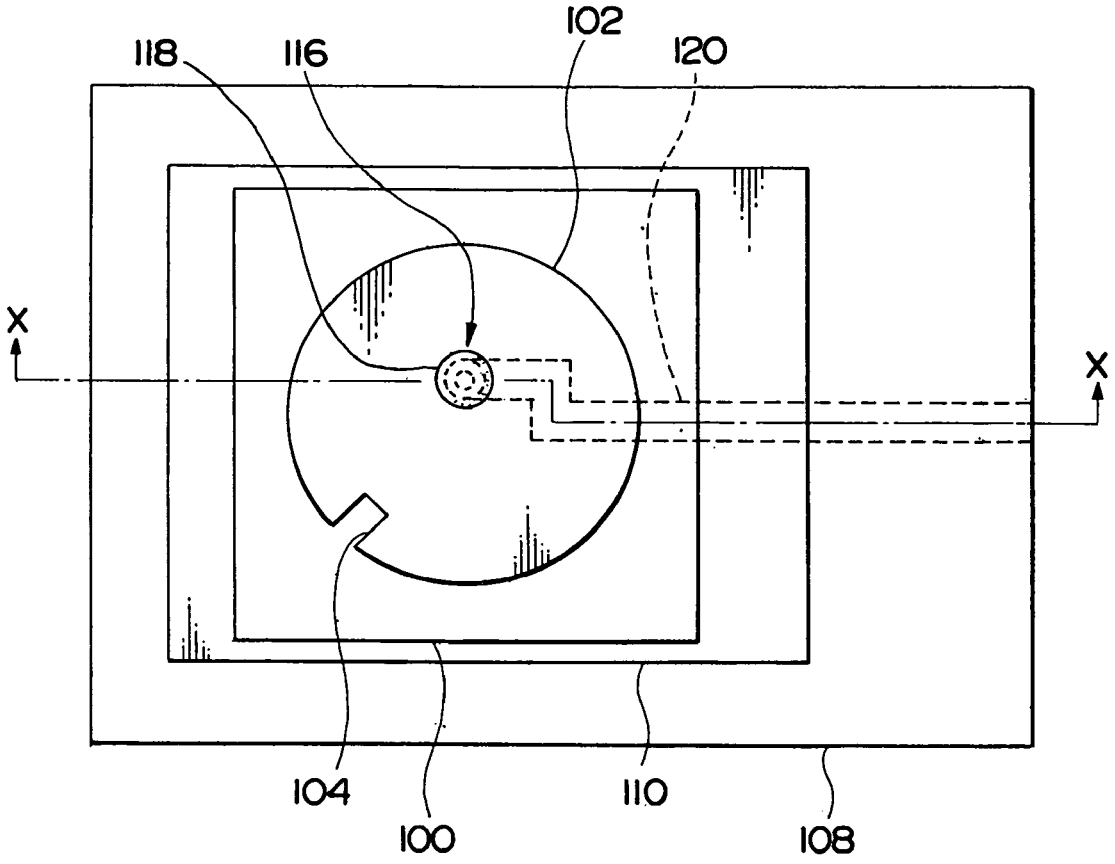
FIG. 9 is a plan view showing a plane antenna according to a first embodiment of the present invention.
Figure 10:
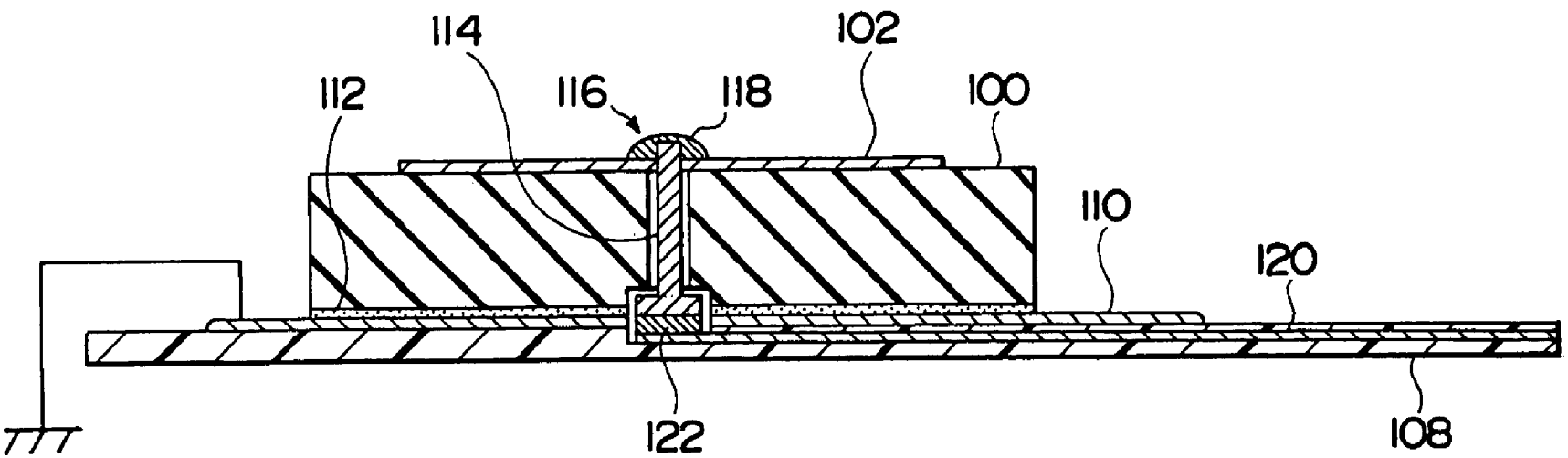
FIG. 10 is a sectional view taken along line X—X of the plane antenna shown in FIG. 9.

An antenna element, a method of mounting thereof and a plane antenna according to a first embodiment of the present invention are explained by referring to FIG. 9 and FIG. 10. FIG. 9 is a plan view showing an antenna element and the plane antenna according to the first embodiment, and FIG. 10 is a sectional view taken along line X—X of FIG. 9.

A dielectric substrate 100 which is a structural element of an antenna element, for example, is a square-board-shaped flat member, and is constructed by a fired substance of ceramics and soon. On a surface of the dielectric substrate 100, an antenna pattern part 102 is provided. The antenna pattern part 102, for example, is formed by evaporation or printing of a conductive metal of silver and so on. In this case, although the antenna pattern part 102 is a circular patch, a shape other than a circular may also be used. A notch 104 formed in the antenna pattern part 102 is for frequency tuning. As frequency adjustment means like this, a slot may also be formed.

The dielectric substrate 100 is provided on a circuit base board, for example, a printed circuit base board 108. In this case, a ground pattern part 110 is formed as a ground plate on an upper face of the printed circuit base board 108, and the dielectric substrate 100 is glued to the upper face portion of the ground pattern part 110 by an elastically adhesive material, for example, by placing a double adhesive tape 112 having adhesive layers at its both faces between them; and is fixed therein. The ground pattern part 110 is connected to a mounting portion of a device casing not shown in the drawings to be grounded.

Further, a junction conductor 114 is made to pierce the dielectric substrate 100, its one end portion is connected to a feeding point 116 of the antenna pattern part 102 by solder 118, and its the other end portion is connected to a feeding pattern part 120 constructing a feeding line or a feeding conductor by solder 122. The printed circuit base board 108 is a multilayer substrate which is formed by sandwiching an insulating plate and a conductor pattern part alternately, and the feeding pattern part 120 is an inner layer conductor of the printed circuit base board 108.

Figure 11:
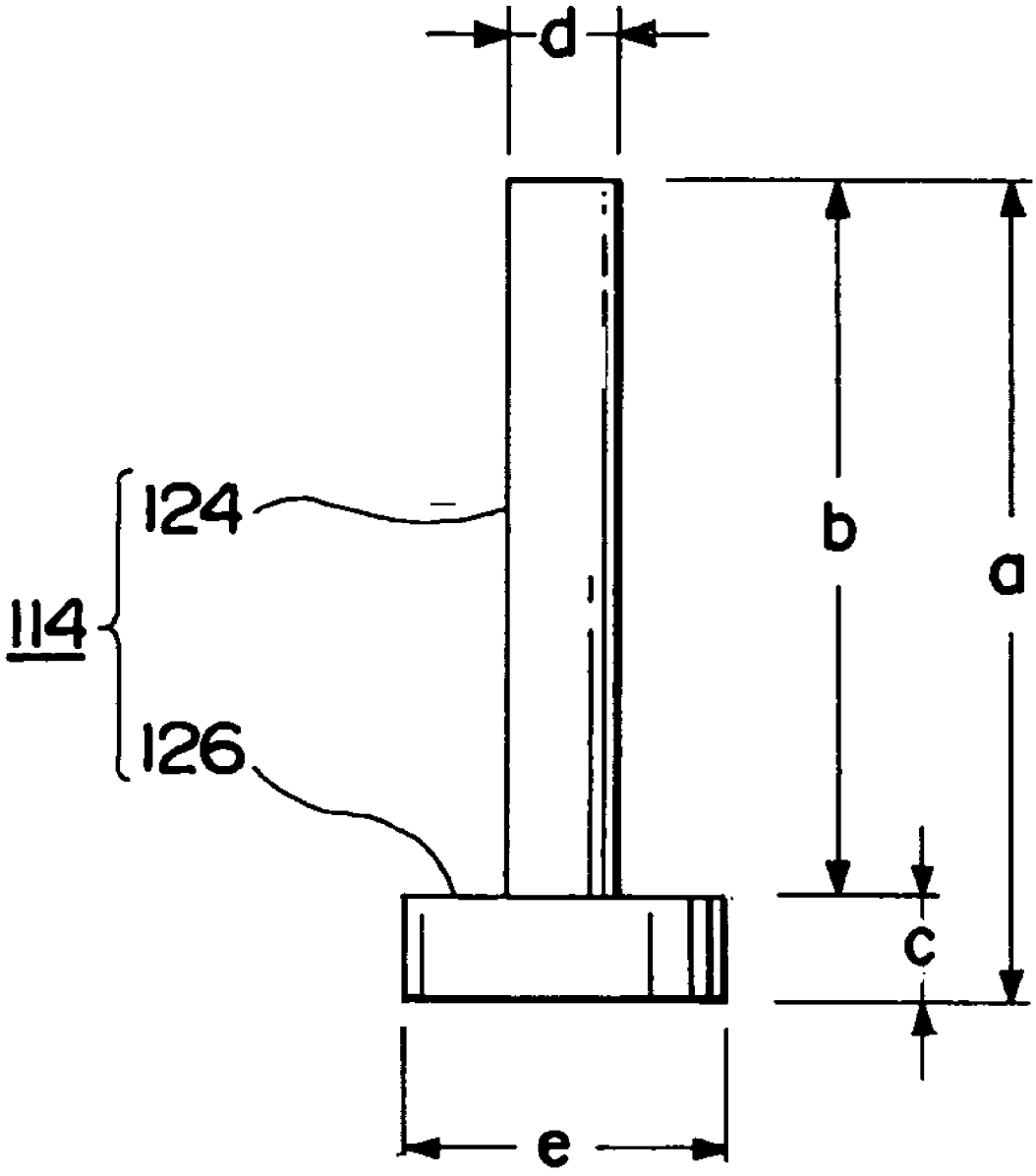
FIG. 11 is a side view showing a junction conductor.
Figure 12:
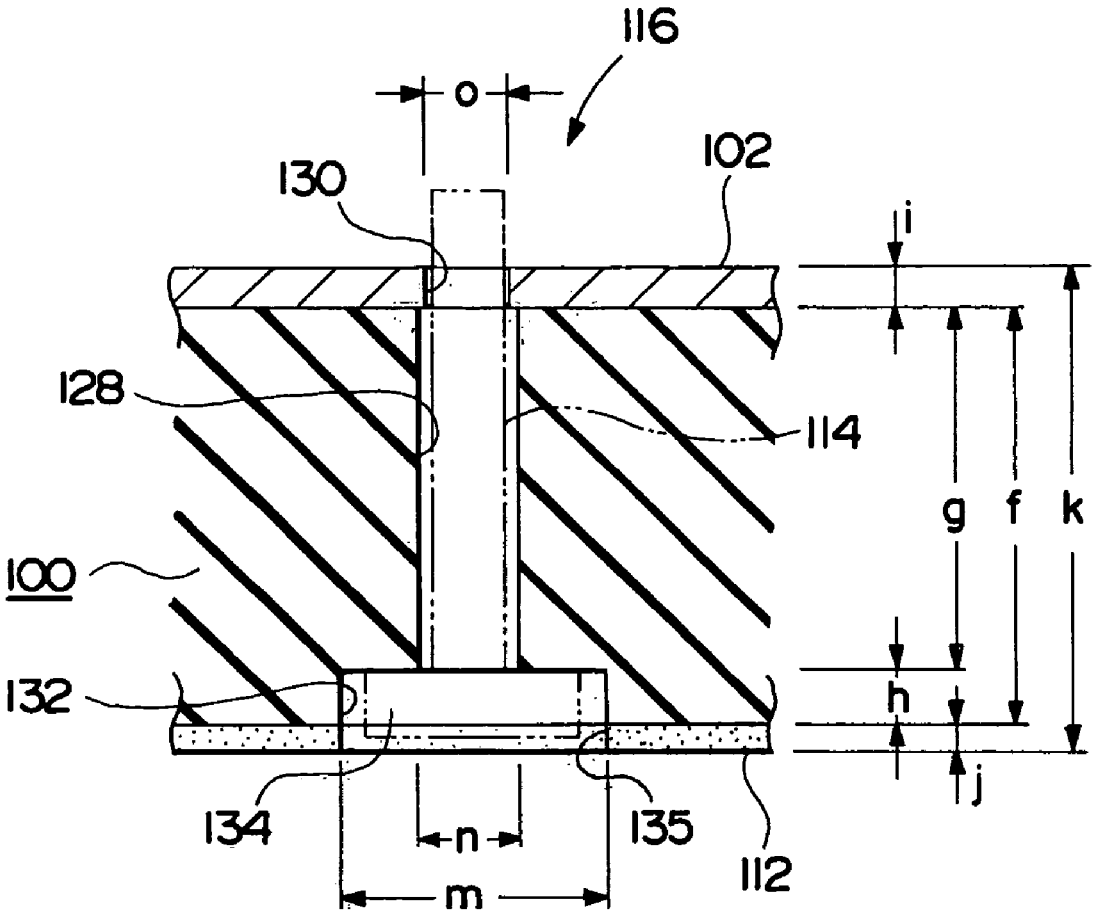
FIG. 12 is a sectional view showing a portion of a through hole of a dielectric substrate.
Figure 13:
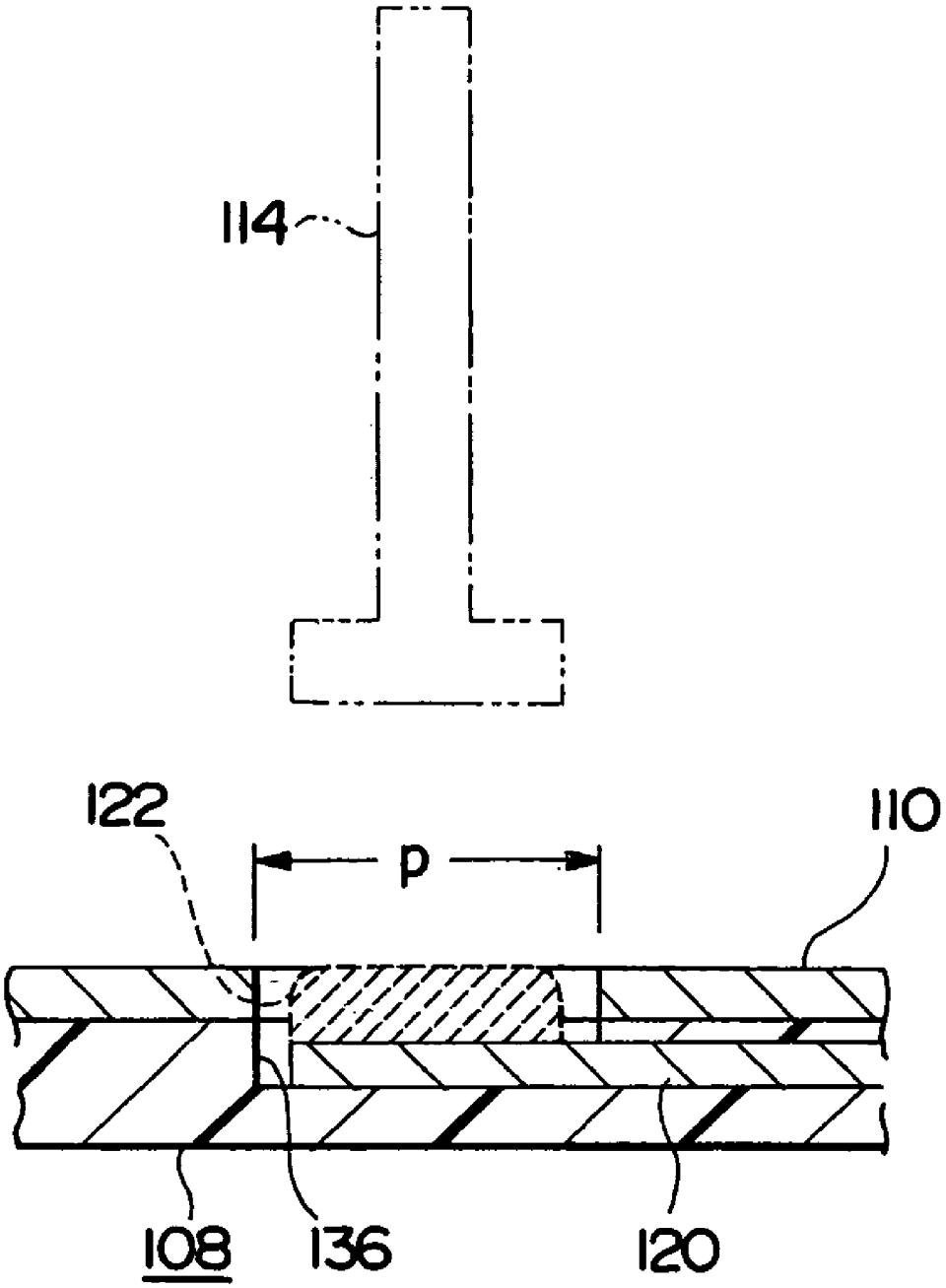
FIG. 13 is a sectional view showing a connected portion of a printed circuit base board.

Although a surface mounting construction which has an antenna element 138A (FIG. 14) or an antenna element 138B (FIG. 16) as an antenna element is realized by a construction mentioned above, this surface mounting construction is explained in detail by referring to FIG. 11, FIG. 12 and FIG. 13. FIG. 11 shows the junction conductor 114, FIG. 12 shows an adjacent portion of a through hole 128 of the dielectric substrate 100, and FIG. 13 shows a connected portion of the printed circuit base board 108.

The junction conductor 114 is formed by a metal having good conductivity such as copper or silver, and, as shown in FIG. 11, has a circular-cylinder-shaped pillar portion 124. Further, a plate-shaped flange portion 126 is formed at one end portion of the junction conductor 114. The flange portion 126 is formed as a body with the pillar portion 124 by shaping the one end portion of a bar-shaped member. When the pillar portion 124 has a circular cylinder shape, a plane shape of the flange portion 126 may also be any of a circle and a rectangle. Here, for the purpose of explanation, it is assumed that total length of the junction conductor 114 is represented by "a", height of the pillar portion 124 is represented by "b", thickness of the flange portion 126 is represented by "c", a diameter of the pillar portion 124 is represented by "d" and a diameter of the flange portion 126 is represented by "e". In this case, the thickness "c" of the flange portion 126 and the diameter "d" of the pillar portion 124 are set to "d=c" or "d≈c".

Further, as shown in FIG. 12, a through hole 128 is formed in the dielectric substrate 100 correspondingly to the pillar portion 124 of the junction conductor 114, and this through hole 128 is formed at a portion corresponding to the feeding point 116 of the antenna pattern part 102. In the feeding point 116 of the antenna pattern part 102, a through hole 130 with a small diameter able to pierce the pillar portion 124 of the junction conductor 114 is formed. Further, in an opening portion of a lower face side of the through hole 128, a space portion 134 is formed by a recess portion 132 which is larger in a diameter than the through hole 128. In this case, an opening 135 is formed in the double adhesive tape 112 so as to extend the recess portion 132, and thereby the space portion 134 is enlarged. This space portion 134 is formed lager than an external shape of the flange portion 126 of the junction conductor 114, namely, the space portion 134 has shape and volume able to house the flange portion 126.

Here, assuming that thickness of the dielectric substrate 100 is represented by "f", thickness of the dielectric substrate 100 in the case of looking from a ceiling face of the recess portion 132 is represented by "g", depth of the recess portion 132 is represented by "h", thickness of the antenna pattern part 102 is represented by "i", thickness of the double adhesive tape 112 is represents by "j", total height of the antenna pattern 102, the dielectric substrate 100 and the double adhesive tape 112 is represented by "k" (=i+f+j=i+g+h+j), a diameter of the recess portion 132 is represented by "m", a diameter of the though hole 128 is represented by "n" and a diameter of the through hole 130 of the antenna pattern part 102 is represented by "o", the dimensional relation among these is in relation of "d≦o<n<m".

Further, the flange portion 126 of the junction conductor 114 and the dielectric substrate 100 are in relation of "e<m" so that clearance serving as a sufficient insulating space between an inner wall of the recess portion 132 and an outer wall of the flange portion 126 is obtained, and these are in relation of "d<n" similarly. Also, these are in relation of "g<b" and "g+i<b" so that, when inserting the pillar portion 124 of the junction conductor 114 into the through hole 128 of the dielectric substrate 100 and pushing the flange portion 126 up, the junction conductor 114 protrudes sufficiently in order to pierce the through hole 130 of the antenna pattern part 102 and connect with the antenna pattern part 102.

In addition, in a side of the printed circuit base board 108, as shown in FIG. 13, a recess portion 136 which makes the feeding pattern part 120 expose is formed. Assuming that an aperture diameter of this recess portion 136 is represented by "p", this aperture diameter "p" has a size necessary for setting a sufficient insulating space between the recess portion 136 and solder 122 when soldering the flange portion 126 of the junction conductor 114. In this case, the dimensional relation among the recess portion 132, the flange portion 126 and the recess portion 136 is "m≈p" or "m=p" and "e<p". In this case, an opening portion formed in the ground pattern part 110 correspondingly to the recess portion 136 may also be formed lager than the recess portion 136.

Therefore, in this antenna element, the connection between the junction conductor 114, which pierces the dielectric substrate 100, and the feeding pattern part 120, which is a feeding conductor, is performed at the upper face side of the printed circuit base board 108, and thereby a connecting process at the back face side of the printed circuit base board 108 is dissolved. Like this, a surface mounting construction in which a connection at the upper face side of the printed circuit base board 108 namely at its one face side can be performed is realized. As a result of this, other components can be provided on the rear face side of the antenna element freely, and thereby restriction against component arrangement in the vicinity of the antenna element is dissolved. Because of this, the mounting area for components will be enlarged and the degrees of freedom in the installation of an antenna element is heightened.

Further, since a connection between the antenna pattern part 102 and the junction conductor 114 and a connection between the junction conductor 114 and the feeding pattern part 120 are performed at one face side of the printed circuit base board 108, its connecting process can be simplified. Along with this, it is not necessary to form a through hole in the printed circuit base board 108 like a prior art, and a pattern design considering the through hole becomes unnecessary. Because of this, the degrees of freedom in a pattern design of the printed circuit base board 108 will be heightened.

Further, in this plane antenna, the dielectric substrate 100 is glued to the upper face of the ground pattern part 110 of the printed circuit base board 108 by the double adhesive tape 112 and is fixed therein. Since the double adhesive tape 112 has necessary binding force and proper elasticity, the dielectric substrate 100 is stably glued on the printed circuit base board 108, and a fixed condition with proper elasticity is maintained.

As descried above, according to this antenna element or plane antenna, a surface mounting construction in which a connection between the junction conductor 114 piercing the dielectric substrate 100 and the antenna pattern part 102 and a connection between the junction conductor 114 and the feeding conductor (the feeding pattern part 120) can be managed at one face side of the circuit base board (the printed circuit base board 108) can be realized, and thereby, along with the simplification and easiness of a connecting process, production efficiency can be heightened. Since the junction conductor 114 is not pierced to the printed circuit base board 108, a process forming the through hole in the circuit base board is unnecessary. Because of this, for example, a pattern design of wired conductors can be performed without considering the through hole, and thereby the degrees of freedom in a design can be heightened. Further, since the feeding conductor is provided in an inner layer portion of the circuit base board and is removed from the rear face side of the circuit base board, for example, other components can be mounted on the back face side of the circuit base board, and a component and so on can be provided so as to adhere closely to its back face. Because of this, the enlargement of a mounting area for components and the improvement of high density of mounted components can be given.

(Second Embodiment)

Figure 14:
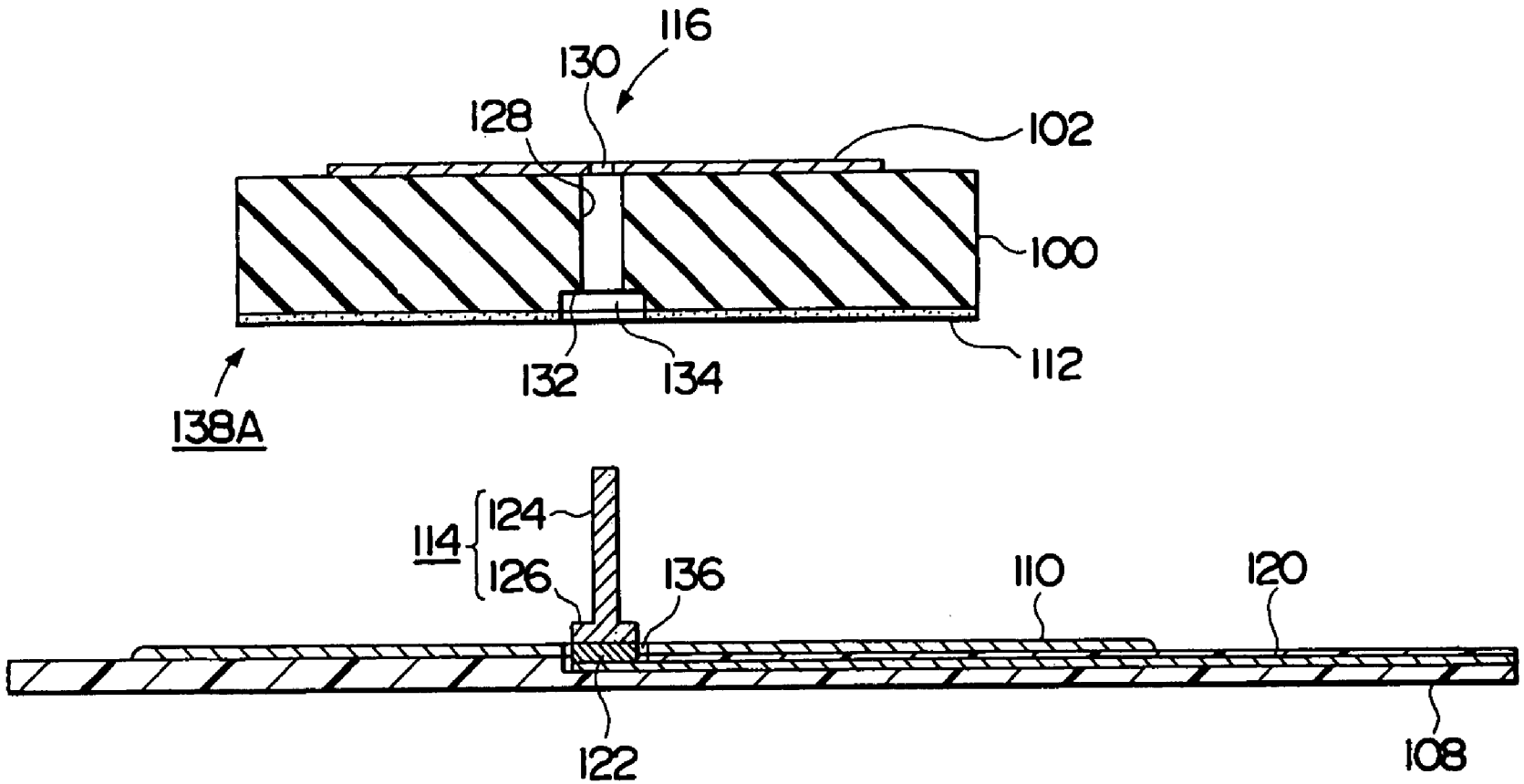
FIG. 14 is an exploded sectional view showing an antenna element and a plane antenna according to a second embodiment of the present invention.
Figure 15:
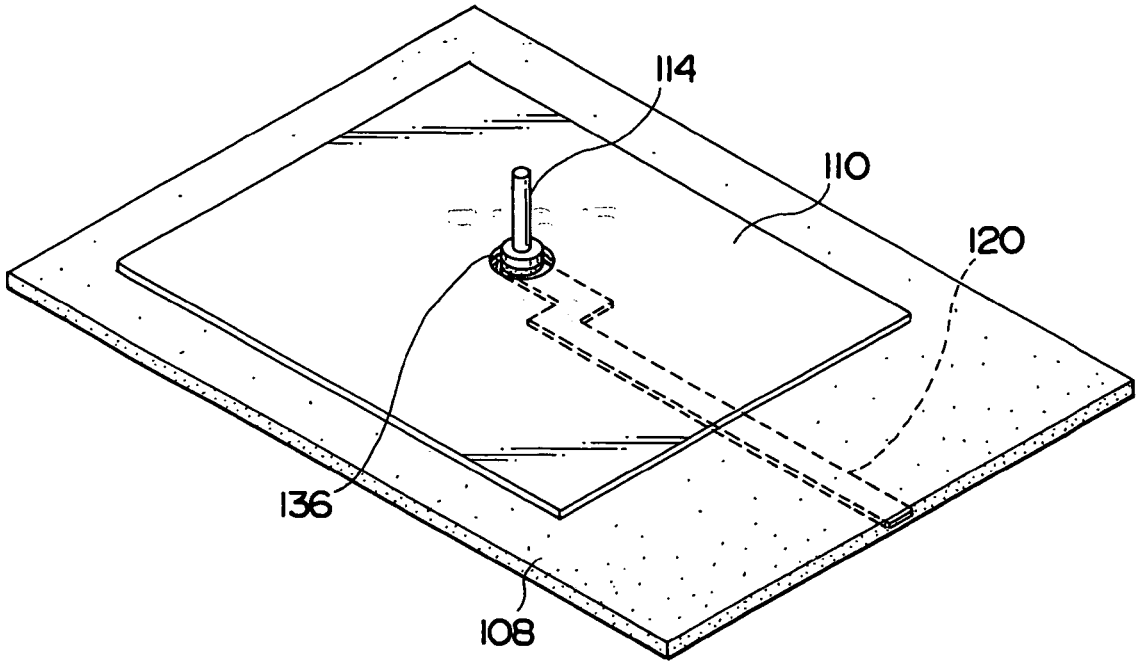
FIG. 15 is a perspective view showing a printed circuit base board before assembling of the plane antenna according to the second embodiment.

Next, an antenna element, a method of mounting thereof and a plane antenna according to a second embodiment of the present invention are explained by referring to FIG. 14 and FIG. 15. FIG. 14 is an exploded sectional view showing an antenna element and a plane antenna according to the second embodiment, and FIG. 15 is a perspective view showing a construction of a circuit base board side before assembling.

The second embodiment shows a mounting construction and method of an antenna element or a plane antenna according to the present invention to a circuit base board. In this embodiment, an antenna element 138A is constructed by the dielectric substrate 100 and the antenna pattern part 102 that is, the antenna pattern part 102 is formed on the flat dielectric substrate 100. Along with this, the through hole 128 corresponding to the through hole 130 formed at its feeding point 116 is formed, the recess portion 132 is formed at the opening portion of the through hole 128, and the space portion 134 is formed by this recess portion 132. Further, to the flat lower face portion of the dielectric substrate 100 of this antenna element 138A, the double adhesive tape 112 is glued as adhering means.

In order to correspond to the antenna element 138A of a construction like this, the ground pattern part 110 is formed on the surface of the printed circuit base board 108, the feeding pattern part 120 is formed in its inner layer portion, the feeding pattern part 120 is exposed correspondingly to the recess portion 132 of the dielectric substrate 100, and the recess portion 136 having a space which insulates between the ground pattern part 110 and the feeding pattern part 120 is formed. To the feeding pattern part 120 of this recess portion 136, the flange portion 126 of the junction conductor 114 is provided, and the feeding pattern part 120 and the flange portion 126 are connected by the solder 122. By this connection, as shown in FIG. 15, the junction conductor 114 is stood on the upper face of the printed circuit base board 108.

Further, when the antenna element 138A is glued to the ground pattern part 110 by the double adhesive tape 112 so that the junction conductor 114 stood on the printed circuit base board 108 pierces the through hole 128 of the dielectric substrate 100 of the antenna element 138A, the pointed end portion of the pillar portion 124 of the junction conductor 114 can be protruded from the through hole 130 of the antenna pattern part 102 when the pointed end portion of this pillar portion 124 and the antenna pattern part 102 are connected by the solder 118 (FIG. 9 and FIG. 10), the antenna pattern part 102 can be electrically connected through the junction conductor 114 to the feeding pattern part 120 at the feeding point 116. Therefore, the antenna element of the surface mounting construction shown in FIG. 9 and FIG. 10 can be constructed. According to a construction like this, since the junction conductor 114 is stood on the printed circuit base board 108 in advance and the antenna pattern part 102 and the feeding pattern part 120 can be connected on the printed circuit base board 108, the surface mounting construction at one face side of the printed circuit base board 108 can be realized. Because of this, the degrees of freedom in the mounting of an antenna element will be enlarged, and the mounting area for components in the rear face side of the printed circuit base board 108 will also be enlarged.

Further, in this antenna element, since the flange portion 126 is formed in the junction conductor 114, this flange portion 126 and the feeding pattern part 120 can be connected by the solder 122 with ease. In addition, the large diameter recess portion 132 is formed at the through hole 128 of the dielectric substrate 100, and the flange portion 126 of the junction conductor 114 and the solder 122 for its connection are housed in the space portion 134 formed by this recess portion 132. Because of this, the antenna element 138A which is surface-mounted is arranged horizontally on the printed circuit base board 108 and can be fixed therein without making the antenna element 138A incline.

(Third Embodiment)

Figure 16:
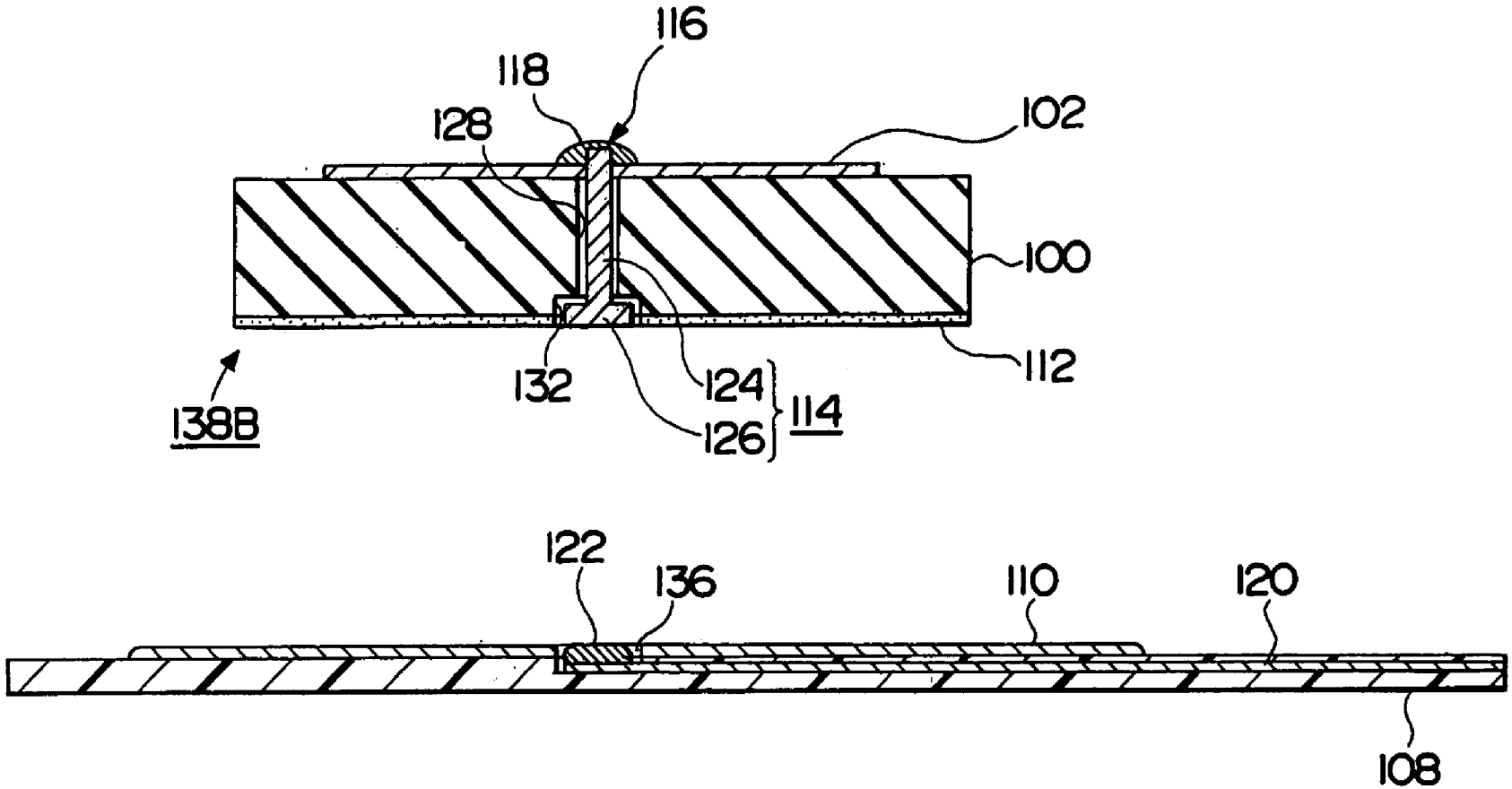
FIG. 16 is an exploded sectional view showing an antenna element and a plane antenna according to a third embodiment of the present invention.
Figure 17:
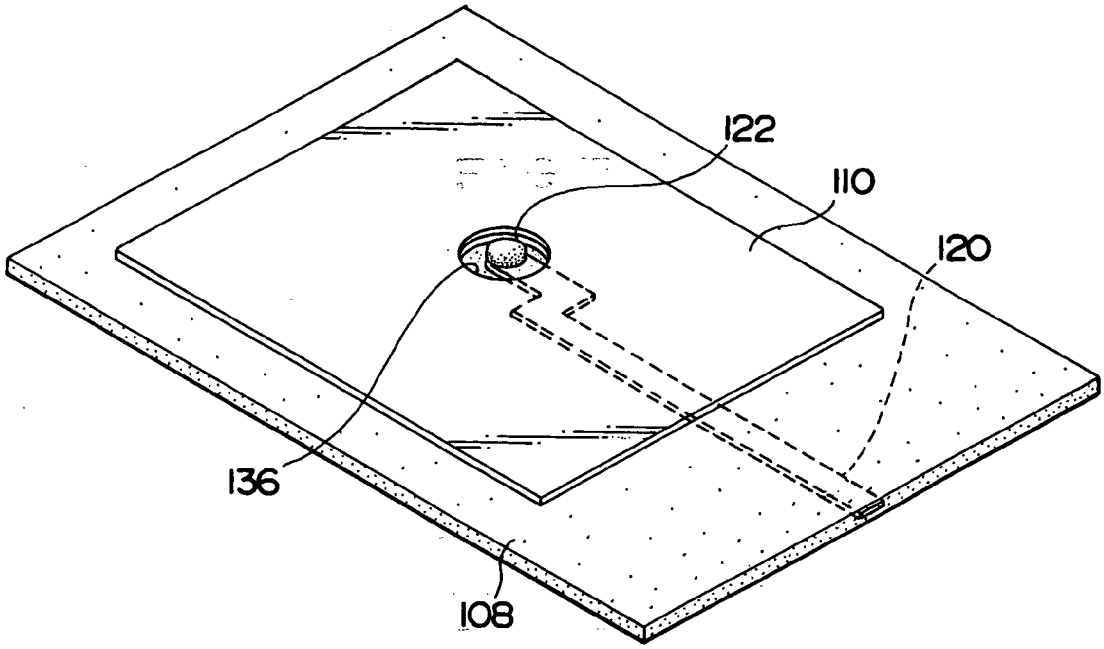
FIG. 17 is a perspective view showing a printed circuit base board before assembling of the plane antenna according to the third embodiment.

Next, an antenna element, a method of mounting thereof and a plane antenna according to a third embodiment of the present invention are explained by referring to FIG. 16 and FIG. 17. FIG. 16 is an exploded sectional view showing an antenna element and a plane antenna according to the third embodiment, and FIG. 17 is a perspective view showing a construction of a side of the printed circuit base board 108 before assembling.

The third embodiment shows a mounting construction of an antenna element or a plane antenna according to the present invention to a circuit base board and a method of mounting thereof. In this embodiment, an antenna element 138B is constructed by attaching the junction conductor 114 to the antenna element 138A in the second embodiment. In this antenna element 138B, the pillar portion 124 of the junction conductor 114 pierces the through hole 128 of the dielectric substrate 100, its pointed end portion which protrudes from the through hole 130 (FIG. 12) of the antenna pattern part 102 is connected to the feeding point 116 by the solder 118, and its flange portion 126 is arranged in the side of the space part 134 of the dielectric substrate 100. In this case, the lower face portion of the flange portion 126 of the junction conductor 114 is made to coincide with the lower face of the double adhesive tape 112 in consideration of elasticity of the double adhesive tape 112. That is, it is set so that, when pressing the antenna element 138B from above at the time of fixing thereof, the lower face of the flange portion 126 of the junction conductor 114 can protrude from the lower face of the double adhesive tape 112 which contracts.

In order to correspond to the antenna element 138B of a construction like this, in one face side of the printed circuit base board 108, the feeding pattern part 120 is exposed correspondingly to the recess portion 132 of the dielectric substrate 100, and the recess portion 136 having a space which insulates between the ground pattern part 110 and the feeding pattern part 120 is formed.

Further, the recess portion 136 of the printed circuit base board 108 and the recess portion 132 of the side of the antenna element 138B are met, the dielectric substrate 100 of the antenna element 138B is glued to the upper face of the ground pattern part 110 of the printed circuit base board 108 by the double adhesive tape 112, and thereby both of them can be fixed. Before this fixing, as shown in FIG. 17, the solder 122 is placed on the feeding pattern part 120 which is exposed to the recess portion 136 of the printed circuit base board 108. And, by the flange portion 126 of the junction conductor 114 of the side of the antenna element 138B being put on the solder 122, the feeding pattern part 120 and the flange portion 126 of the junction conductor 114 can be electrically connected by the solder 122 along with adhesion and fixing of the antenna element 138B by means of the double adhesive tape 112. In this case, if the antenna element 138B is pushed to the side of the printed circuit base board 108, the double adhesive tape 112 is compressed and the flange portion 126 of the junction conductor 114 can be made to enter the side of the solder 122. Thereby, the adhesion and connection are performed simultaneously, and, along with the surface mounting of a plane antenna, an electrical connection having high reliability becomes possible. According to this embodiment, similarly to the second embodiment, the plane antenna and the construction of mounting thereof shown in FIG. 9 and FIG. 10 can be realized. Also according to a construction like this, since the junction conductor 114, which is connected to the antenna pattern part 102, and the feeding pattern part 120 can be connected on the printed circuit base board 108, the surface mounting construction at one face side of the printed circuit base board 108 can be realized. Because of this, the degrees of freedom in the mounting of a plane antenna will be enlarged, and the mounting area for components in the rear face side of the printed circuit base board 108 will also be enlarged.

(Fourth Embodiment)

Figure 18:
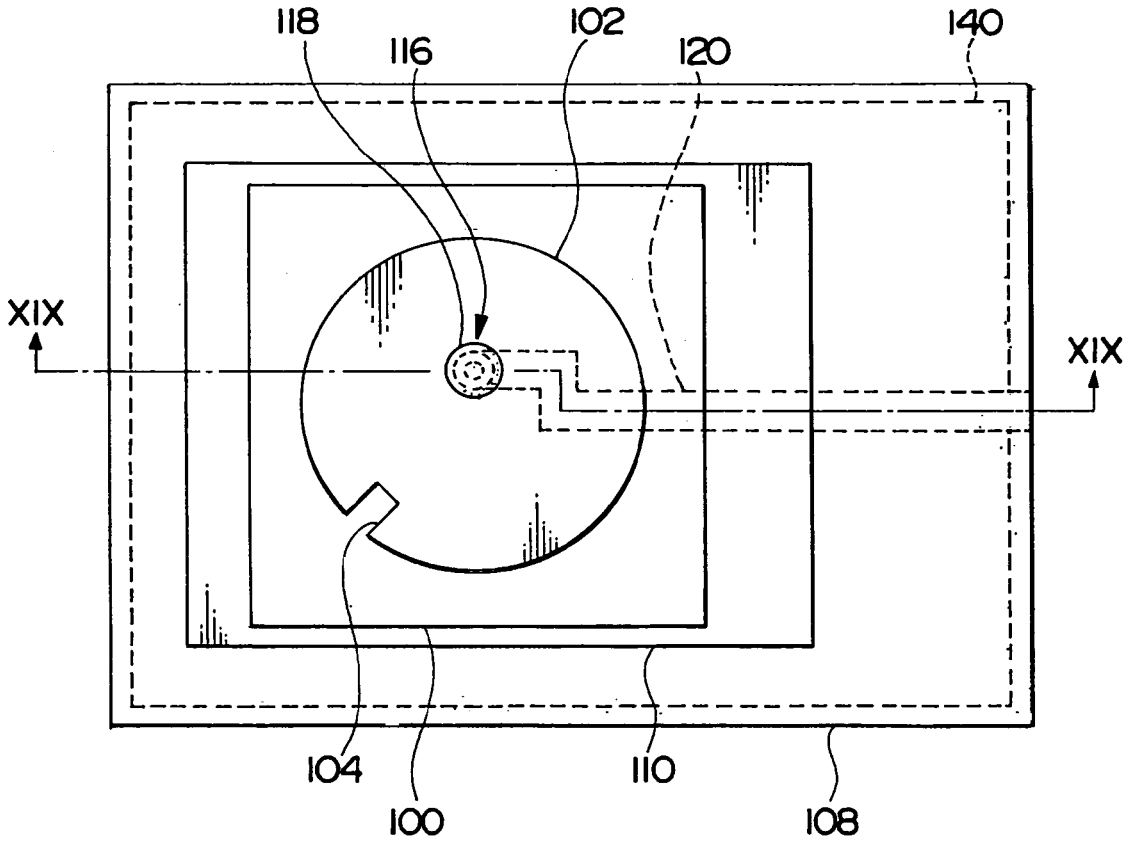
FIG. 18 is a plan view showing a plane antenna according to a fourth embodiment of the present invention.
Figure 19:
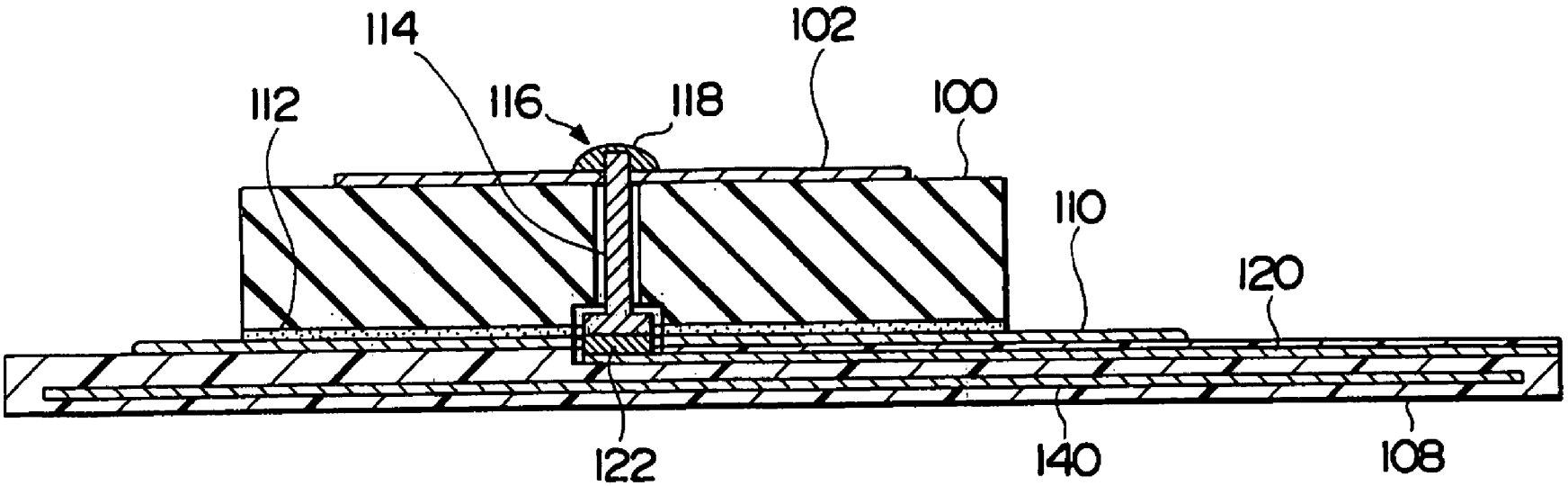
FIG. 19 is a sectional view taken along line XIX—XIX of the plane antenna shown in FIG. 18.

Next, an antenna element, a method of mounting thereof and a plane antenna according to a fourth embodiment of the present invention are explained by referring to FIG. 18 and FIG. 19. FIG. 18 is a plan view showing an antenna element and a plane antenna according to the fourth embodiment, and FIG. 19 is a sectional view taken along line XIX—XIX of FIG. 18.

In this embodiment, the first ground pattern part 110 and a second ground pattern part 140 which is an inner layer conductor are provided to the printed circuit base board 108 which is circuit base board. The construction of other portions is the same as the plane antenna shown in FIG. 9 and FIG. 10, and the same reference numerals are given to the same potions.

According to a construction like this, shielding is given to the feeding pattern part 120 and the connected portion between the junction conductor 114 and the feeding pattern part 120 by the ground pattern part 140, and thereby a shielding effect can be improved. As a result, noise strength from the back face side of the printed circuit base board 108 is heightened, and an antenna element having a high SN ratio can be realized. Further, by the ground pattern part 140 of a construction like this, the degrees of freedom in the installation of components to the rear face side of the printed circuit base board 108 is heightened. As a result, the mounting density of components can be heightened, and the degrees of freedom in the installation of an antenna element will be heightened.

(Fifth Embodiment)

Figure 20:
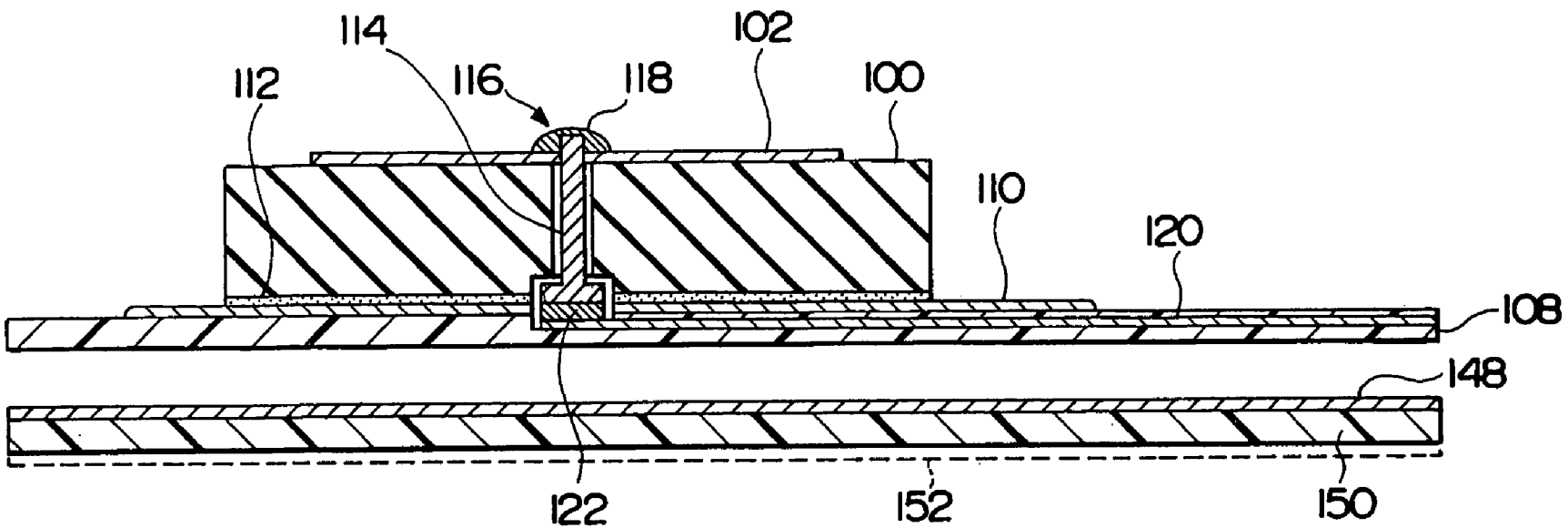
FIG. 20 is a sectional view showing a plane antenna according to a fifth embodiment of the present invention.

Next, an antenna element, a method of mounting thereof and a plane antenna according to a fifth embodiment of the present invention are explained by referring to FIG. 20. FIG. 20 is a sectional view showing an antenna element and a plane antenna according to the fifth embodiment.

In the fourth embodiment described above, the second ground pattern part 140 is provided inside the single printed circuit base board 108 by making the printed circuit base board 108 a multilayer. However, in this embodiment, a second printed circuit base board 150 is provided as a circuit base board on which a ground pattern part 148 is formed, toward the first printed circuit base board 108. In this case, instead of the ground pattern part 148 or along with the ground pattern part 148, a ground pattern part 152 may also be provided on the rear face side of the printed circuit base board 150 as shown in a broken line. The construction of other portions is the same as the plane antenna shown in FIG. 9 and FIG. 10, and the same reference numerals are given. Also according to a construction like this, the same effect as the fourth embodiment can be expected.

(Sixth Embodiment)

Figure 21:
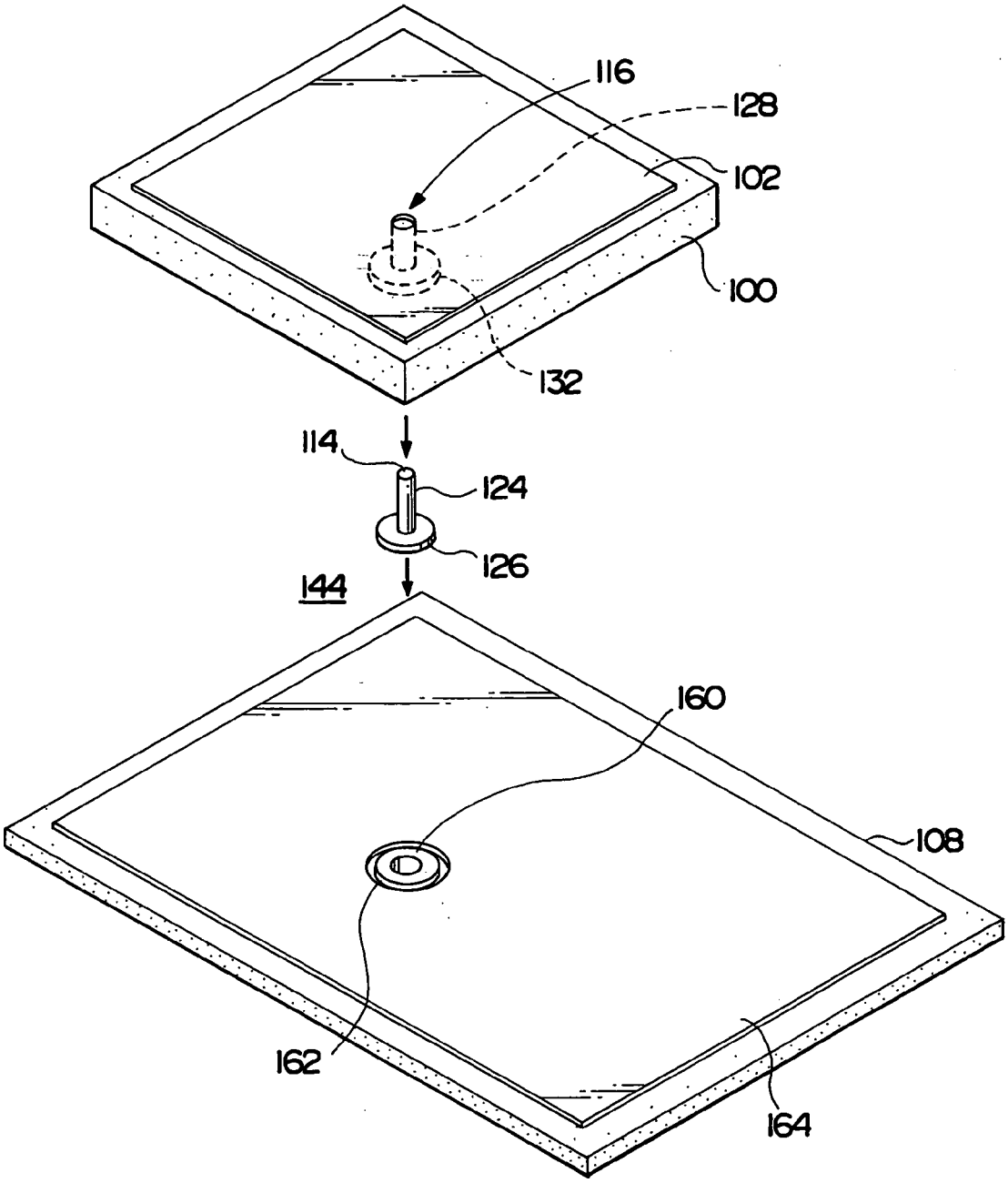
FIG. 21 is an exploded perspective view showing a plane antenna according to a sixth embodiment of the present invention.

Next, a mounting construction and a mounting method of a plane antenna according to a sixth embodiment of the present invention are explained by referring to FIG. 21. FIG. 21 is an exploded perspective view of a plane antenna showing the mounting construction and the mounting method of the plane antenna.

In the printed circuit base board 108, a circular feed connection land 160 is formed, an insulating space 162 is provided around this feed connection land 160, and a ground (GND) pattern 164 is formed so as to cover a surface of the printed circuit base board 108. The plane antenna 144 has the dielectric substrate 100 and the antenna pattern part 102 which is a surface electrode, and the through hole 128 into which the pillar portion 124 of the junction conductor 114 is inserted is formed in the dielectric substrate 100. That is, the through hole 128 is formed at the feeding point 116. Further, the recess portion 132 is formed in the bottom face portion of the dielectric substrate 100 by enlarging an opening dimension of the through hole 128, and the recess portion 132 is formed at the opening portion of the bottom face side of the through hole 128 of the dielectric substrate 100 by means of spot facing processing. In this embodiment, the recess portion 132 is formed with a large diameter on concentric circles with the circular through hole 128 and constructs the space portion 134 (FIG. 12). The junction conductor 114 is also called a feeding pin, and, as described before, at the lower end portion of the pillar portion 124 which is a main body portion of the junction conductor 114, for example, the flange portion 126 with a circular shape is formed. This junction conductor 114, for example, is silvered in order to heighten conductivity. The pillar portion 124 and the flange portion 126 of the junction conductor 114, for example, are a simplex body which is formed from a metal body by cutting processing, and are constructed so that the bottom face of the flange portion 126 is formed with a flat face and this bottom face and the pillar portion 124 have orthogonal relation. According to a construction like this, when the bottom face of the flange portion 126 is joined to the feed connection land 160, the pillar portion 124 of the junction conductor 114 is stood perpendicularly on the surface of the printed circuit base board 108 and is mounted.

In this case, as described before, the joined face between the feed connection land 160 and the flange portion 126 is connected by solder.

A mounting construction of this plane antenna and a mounting method to the printed circuit base board 108 are explained in the following. The solder 122 (FIG. 10) is disposed as preliminary solder processing on the feed connection land 160 of the printed circuit base board 108, and then the junction conductor 114 is mounted thereon. Next, the pillar portion 124 of the junction conductor 114 is inserted into the through hole 128 of the dielectric substrate 100, and the back face side of the dielectric substrate 100 and the ground (GND) pattern 164 of the printed circuit base board 108 are closely glued. For example, the double adhesive tape 112 (FIG. 20) is provided between the back face side of the dielectric substrate 100 and the GND pattern 164, and thereby both of them are fixed. If the length of the junction conductor 114 is set longer about 0.5 mm as an example than the thickness of the dielectric substrate 100, the junction conductor 114 protrudes about 0.5 mm from the surface portion of the antenna pattern part 102 when the dielectric substrate 100 is glued to the printed circuit base board 108. Because of this, this protruding portion and the antenna pattern part 102 can be connected by the solder 118 (FIG. 10). By this, the antenna pattern part 102 of the plane antenna 144 is connected to the feed connection land 160 through the junction conductor 114, and the plane antenna 144 is mounted on the upper face of the printed circuit base board 108.

(Seventh Embodiment)

Figure 22:
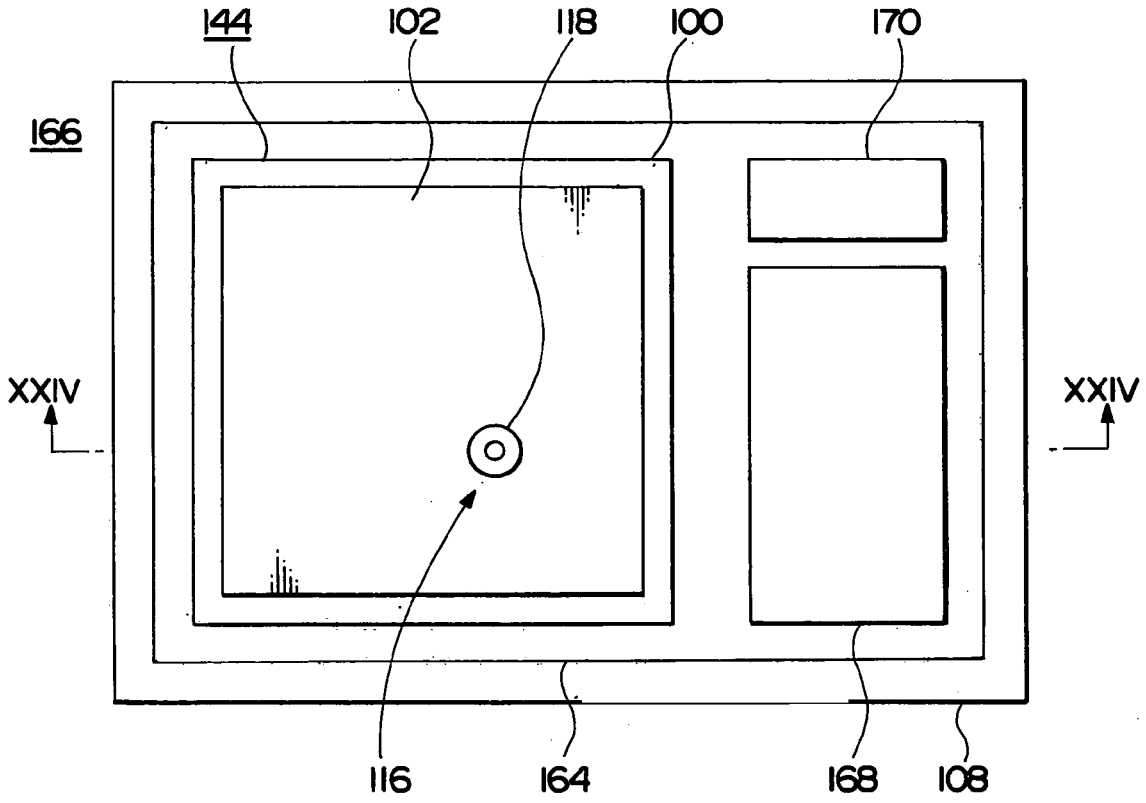
FIG. 22 is a plan view showing a GPS receiving module according to a seventh embodiment of the present invention.
Figure 23:
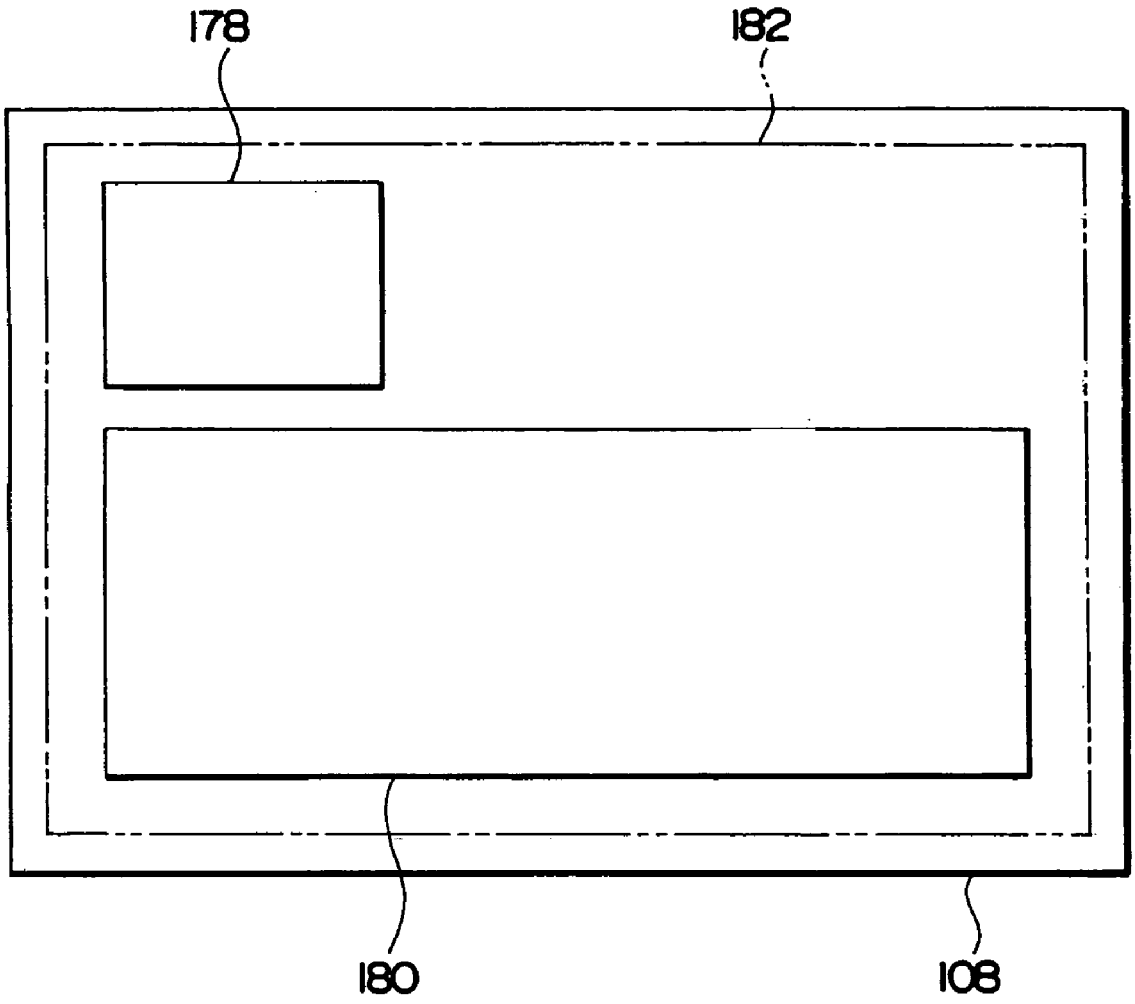
FIG. 23 is a rear view showing the GPS receiving module.
Figure 24:
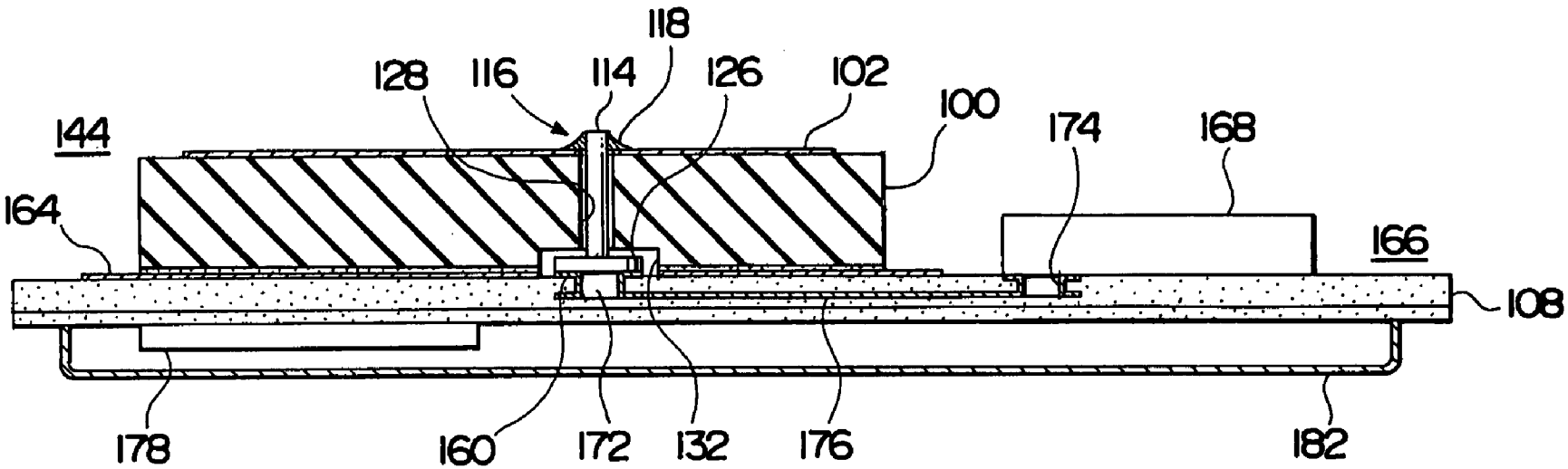
FIG. 24 is a sectional view taken along line XXIV—XXIV of the GPS receiving module shown in FIG. 22.

Next, a GPS receiving module according to a seventh embodiment of the present invention is explained by referring to FIG. 22, FIG. 23 and FIG. 24. FIG. 22 is a plan view in the case of looking the GPS receiving module from its upper face side, FIG. 23 is a drawing in the case of looking the GPS receiving module from its rear face side, and FIG. 24 is a sectional view taken along line XXIV—XXIV of FIG. 22.

In this GPS receiving module 166, the plane antenna 144 and a down converter part 168 are mounted on the printed circuit base board 108, and a position computation signal output terminal part 170 is also formed. The antenna pattern part 102 of the plane antenna 144 is connected to the junction conductor 114 by the solder 118, the flange portion 126 of the junction conductor 114 is connected through the through hole 172 to the feed connection land 160 of the printed circuit base board 108, and the down converter part 168 is connected through the through hole 174 to a transmission line 176 serving as a RF signal line. In the inner wall portions of the through holes 172 and 174, a conductor, not shown in the drawings, which connects between the feed connection land 160 and the transmission line 176 is provided by a plating treatment and so on. As a result, the antenna pattern part 102 of the plane antenna 144 is connected to the down converter part 168 by way of the junction conductor 114 and the transmission line 176. The mounting construction of the plane antenna 144 is as described before. Further, as a result of the plane antenna 144 being mounted at one face side of the printed circuit base board 108 of the GPS receiving module 166, a clock signal generation part 178 and a GPS signal operation processing part 180 are mounted on the printed circuit base board 108 of the rear face side of the plane antenna 144 without avoiding the rear face side of the plane antenna 144, and a shielding cover 182 which covers these clock signal generation part 178 and GPS signal operation processing part 180 is provided.

According to a construction like this, after the junction conductor 114 is mounted perpendicularly on the printed circuit base board 108, the junction conductor 114 is inserted into the through hole 128 of the dielectric substrate 100, the dielectric substrate 100 is installed so as to adhere closely to the printed circuit base board 108, the junction conductor 114 is connected to the antenna pattern part 102 by the solder 118, and thereby the mounting of the plane antenna 144 is completed. In this case, the flange portion 126 of the junction conductor 114 is arranged in the space portion 134 which is formed by the recess portion 132 of the dielectric substrate 100, and physical interference with the dielectric substrate 100 is avoided. Further, the antenna pattern part 102 of the plane antenna 144, as shown in FIG. 24, is connected to the down converter part 168 by way of the junction conductor 114 and the transmission line 176, and an RF signal received with the plane antenna 144 is output to the down converter part 168.

Further, the GND pattern 164 which is arranged on the surface of the printed circuit base board 108 is provided between the plane antenna 144 and the transmission line 176. Because of this, even if a digital device, such as a DSP generating a noise, is arranged on a face opposite to a mounting face of the plane antenna 144, the coupling of a radiation noise to the down converter part 168 is prevented because of having the construction sandwiching the GND layer in the intermediate portion, and the deterioration of the receiving sensitivity performance of a GPS receiver does not occur. In addition, since another circuit part can be mounted on the face side opposite to the mounting face of the plane antenna 144, a mounting region of the printed circuit base board 108 can be enlarged. As a result, since a dead space of the mounting region in the case of installing the plane antenna 144 can be omitted, the miniaturization of a device will be given.

(Eighth Embodiment)

Figure 25:
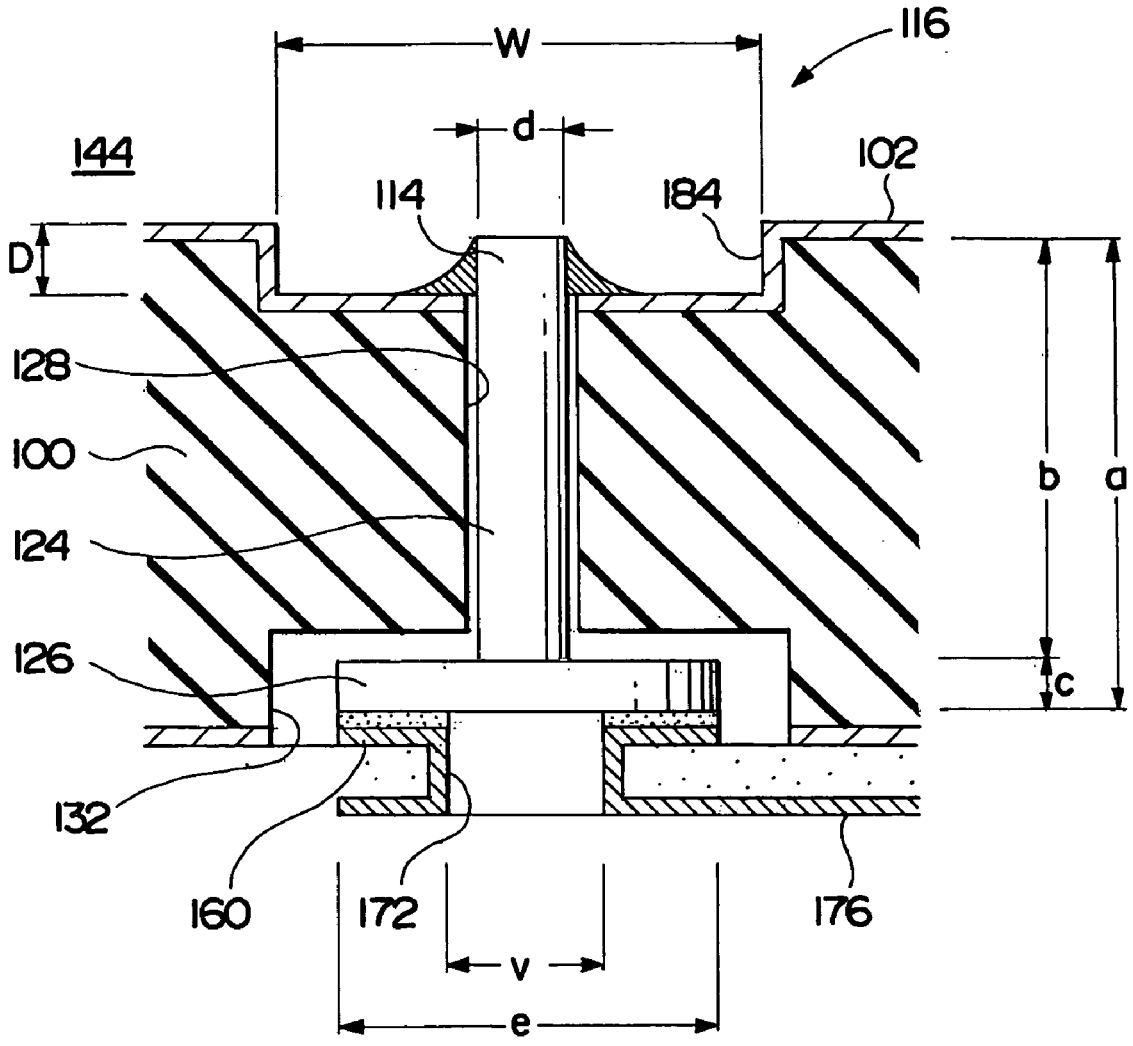
FIG. 25 is an enlarged sectional view showing a portion of a junction conductor of a plane antenna according to an eighth embodiment of the present invention.

Next, a plane antenna and a construction of mounting thereof according to an eighth embodiment of the present invention are explained by referring to FIG. 25. FIG. 25 is an enlarged sectional view showing an installed portion of a junction conductor of the plane antenna.

In this plane antenna 144, a recess portion 184 is formed at the surface portion of the dielectric substrate 100 so as to match with a position of the through hole 128 of the dielectric substrate 100, and the antenna pattern part 102 which is provided on the surface portion of the dielectric substrate 100 is formed so as to cover this recess portion 184. The recess portion 184, for example, is easily formed by spot facing processing. The size of the recess portion 184, for example, is set to a size having a diameter "W" necessary for a connection of the junction conductor 114, and its depth "D" is set so that a connected portion of the junction conductor 114 of the plane antenna 144 which is mounted becomes lower than a top portion of the antenna pattern part 102. By this, a mounting construction in which a connection between the junction conductor 114 and the antenna pattern part 102 can be performed in the recess portion 184 is realized. Hence, for a connection between the junction conductor 114 and the antenna pattern part 102, the antenna pattern part 102 is formed also an inside of the recess portion 184, for example, by means of metalizing processing of a silver material. Further, in order to house the junction conductor 114 in the recess portion 184, the total length "a" of the junction conductor 114 is set to length equal to the thickness "f" of the dielectric substrate 100 or less than the thickness "f" ($a \leqq f$).

According to a construction like this, the recess portion 184 for the connection between the junction conductor 114 and the antenna pattern part 102 is formed in the dielectric substrate 100, and the total length "a" of the junction conductor 114 is set to the length equal to the thickness "f" of the dielectric substrate 100 or less than the thickness "f" ($a \leqq f$). Hence, the junction conductor 114 and the antenna pattern part 102 can be joined within the pointed end portion of the junction conductor 114 not exceeding the thickness of the dielectric substrate 100, namely, within the upper face of the dielectric substrate 100. By this, flatting the upper face portion of the plane antenna 144 is realized.

If the plane antenna 144 of a construction like this is used, for example, in case that it is installed in a mobile phone unit and so on, it is possible to allow the antenna pattern part 102 of the plane antenna 144 to come nearer the vicinity of an inner wall face of a housing case of the mobile phone unit. Because of this, it is possible to thinly construct the housing case of the mobile phone and to contribute to the miniaturization of a device.

(Ninth Embodiment)

Figure 26:
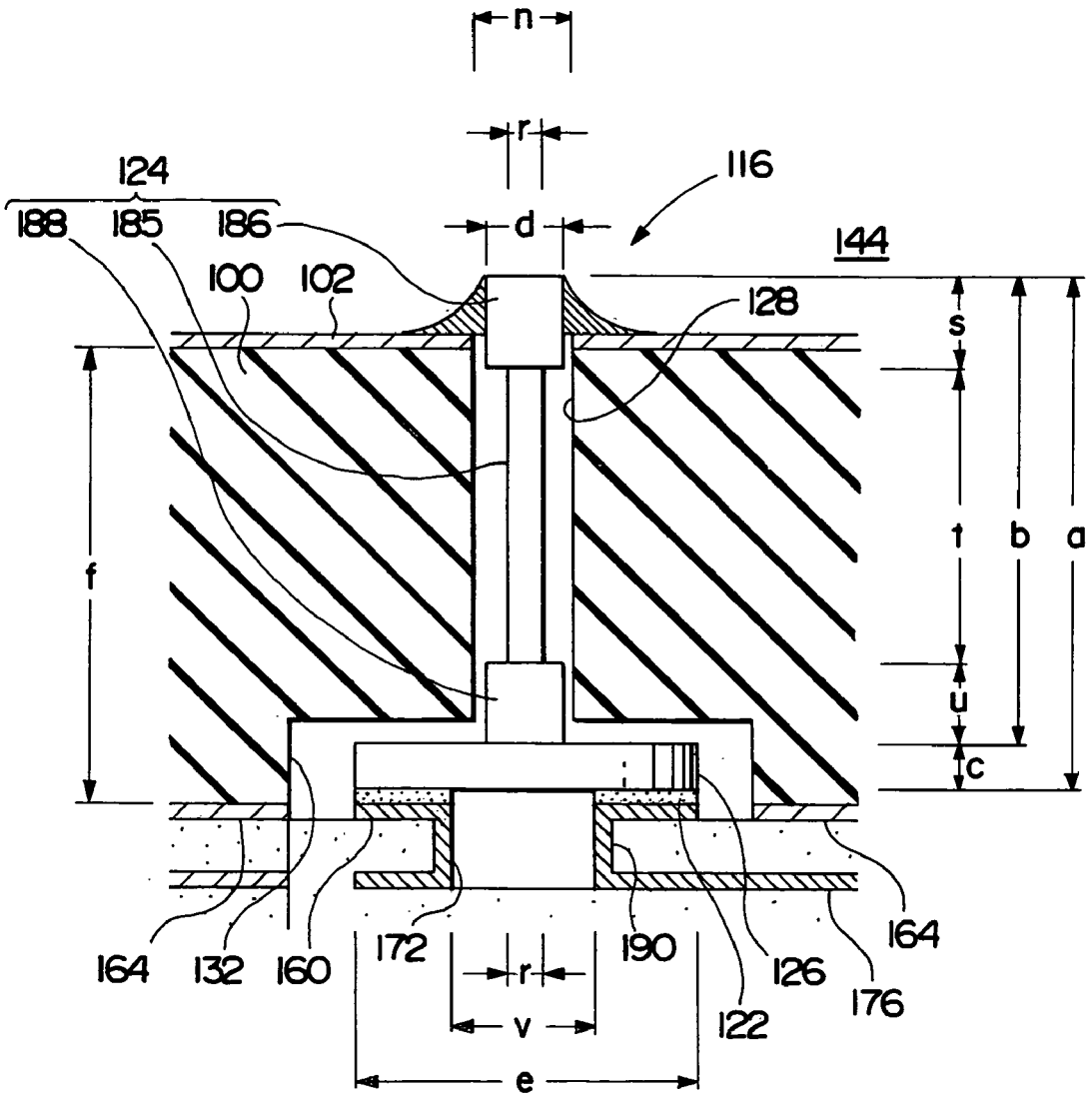
FIG. 26 is an enlarged sectional view showing a portion of a junction conductor of a plane antenna according to a ninth embodiment of the present invention.

Next, a plane antenna and a construction of mounting thereof according to a ninth embodiment of the present invention are explained by referring to FIG. 26. FIG. 26 is an enlarged sectional view showing an installed portion of a junction conductor of the plane antenna.

In this plane antenna 144, a small diameter portion 185 as a slender portion is formed in the intermediate portion of the pillar portion 124 of the junction conductor 114. In this embodiment, large diameter portions 186 and 188 are left at the pointed end portion and a base portion of the pillar portion 124, and the small diameter portion 185 is formed in its intermediate portion. Here, a diameter of the large diameter portions 186 and 188 are represented by "d", length of them are respectively represented by "s" and "u" ($s=u$ or $s \neq u$), a diameter of the small diameter portion 185 is represented by "r" ($<d$) and its length is represented by "t" ($s<t$, $u<t$). And, in this case, "v" is a diameter of the through hole 172, and the diameter "v" is set smaller than a diameter "e" of the flange portion 126.

According to a construction like this, since the small diameter portion 185 is formed in the intermediate portion of the pillar portion 124 of the junction conductor 114, its rigidity becomes lower as compared with a pillar portion having the same diameter. Because of this, if the stress due to flexure of the circuit base board and/or self-weight of the plane antenna 144 is given to the junction conductor 114, for example, in case that this junction conductor is installed in a mobile phone unit and an impact is given by a fall and so on, the stress is absorbed by the small diameter portion 185 and thereby an unforeseen situation of disconnection and so on can be avoided. Although the flange portion 126 of the junction conductor 114 is fixed to the feed connection land 160 by the solder 122, the strength against exfoliation between the feed connection land 160 and a conductor 190 formed in the through hole 172 is weak. However, since the stress is absorbed by the small diameter portion 185 formed in the intermediate portion of the pillar portion 124 of the junction conductor 114, the fear of disconnection at the time of a fall will be dissolved. Like this, if an impact can be absorbed by the junction conductor 114 providing the small diameter portion 185, the disconnection at the side of the connected portion is prevented, and thereby it is possible to contribute to the improvement of mechanical reliability at the time of the fall of a mobile phone unit. In addition, the conductor 190 provided in the through hole 172 is a conductor for connecting the feed connection land 160 and the transmission line 176, and is formed by a plating treatment and so on. Although in this embodiment the through hole 172 is described as a hollow portion, the through hole 172 composed of a small hole may also be stopped up by the conductor 190.

(Tenth Embodiment)

Figure 27:
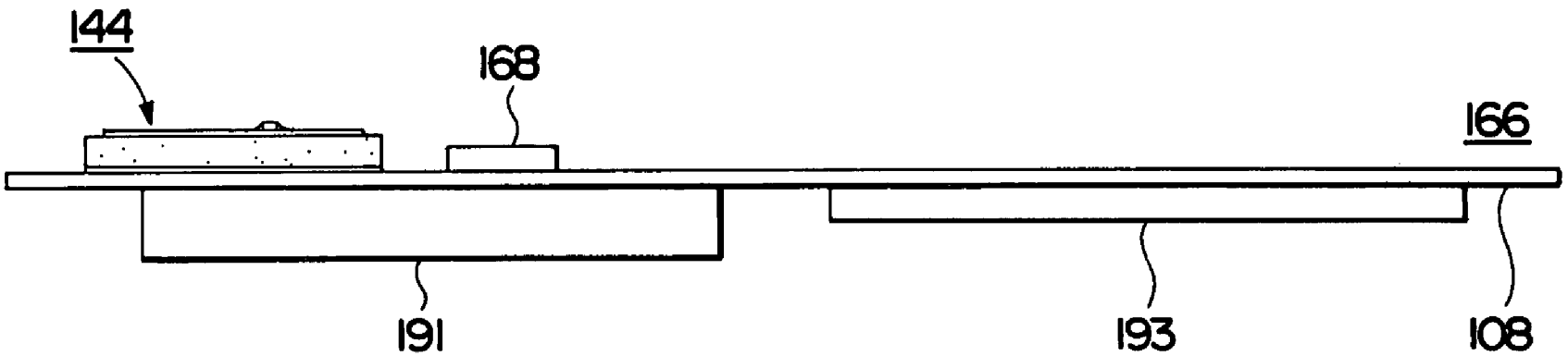
FIG. 27 is a side view showing a GPS receiving module according to a tenth embodiment of the present invention.
Figure 28:
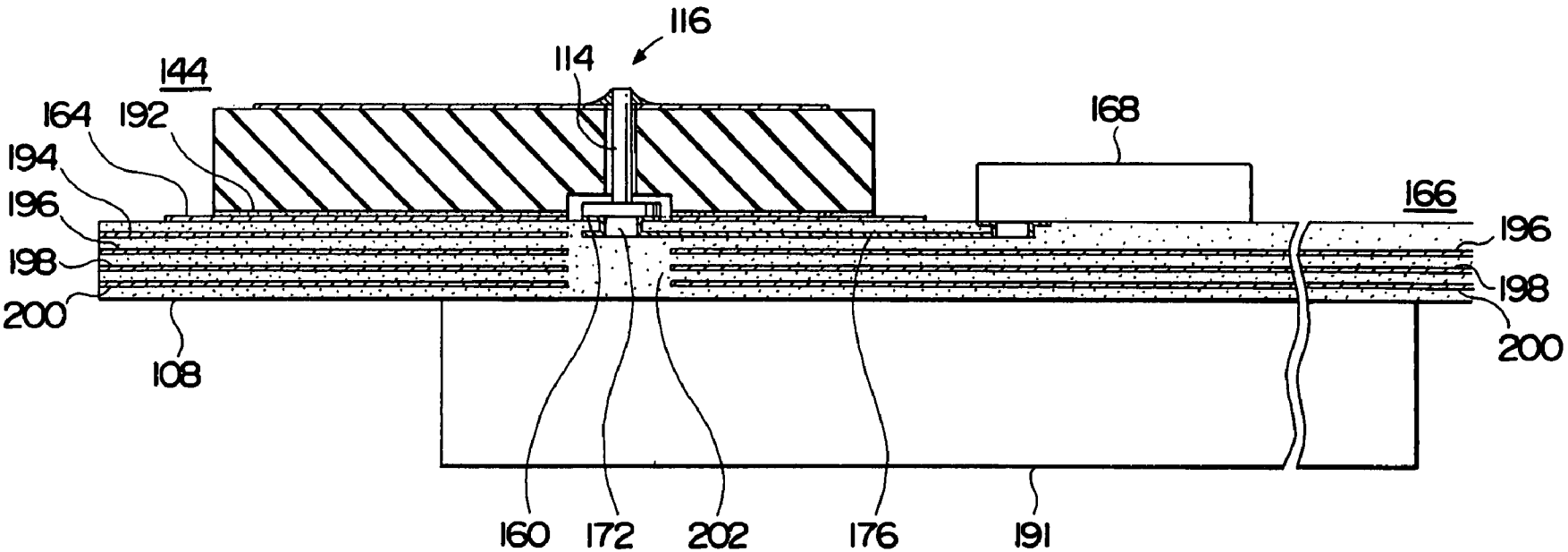
FIG. 28 is a sectional view showing a mounting portion of a plane antenna of the GPS receiving module.

Next, a plane antenna and a construction of mounting thereof according to a tenth embodiment of the present invention are explained by referring to FIG. 27 and FIG. 28. FIG. 27 is a side view showing a GPS receiving module, and FIG. 28 is a drawing showing an installed portion of the plane antenna of the GPS receiving module.

In this embodiment, on the printed circuit base board 108 which constructs the GPS receiving module 166 installed in a mobile phone unit and so on, the plane antenna 144 is mounted, and the down converter part 168 is also mounted. Further, on the rear face side of that, an information display unit 191 of a LCD and so on, and a key input part 193 are also mounted.

Further, the plane antenna 144 is fixed at a mounting position of the printed circuit base board 108, for example, by using a double adhesive tape 192. The printed circuit base board 108 can be constructed by a single layer substrate or a plural layers substrate, and, for example, is constructed by a circuit base board having six layers. Ground conductor layers 194, 196, 198 and 200 of plural layers composed of a plurality of wiring layers are provided as a shielding member, and the transmission line 176 is also provided in the same layer as the ground conductor layer 194. This transmission line 176, as described before, is a line for transmitting the RF signal received by the plane antenna 144, and the RF signal is transmitted to the down converter part 168. The RF signal given to the down converter part 168 through the transmission line 176 is converted the IF signal, and, after that, is given to a GPS signal operation processing part not shown in the drawings on the same base board. In the GPS signal operation processing part, by using information, necessary for the computation of a position which is extracted from the IF signal, operation processing is performed by a DSP. And, position information which is a result of that operation is displayed on the information display unit 191.

In the printed circuit base board 108 of a construction like this, for example, in case that thickness of the base board is 0.6 mm and is thin, if an area of the feed connection land 160 is larger and a ground conductor layer provided in the under side is adjacent, parasitic capacity occurs between the feed connection land 160 and an adjacent ground conductor layer from the relation of [capacity=($\epsilon \times$electrode area)/(inter-electrode distance): however, $\epsilon$ is dielectric constant]. This matter lowers a VSWR (Voltage Standing Wave Ratio) of the plane antenna 144, and becomes a cause deteriorating an antenna performance.

Therefore, in this embodiment, at the under side of the feed connection land 160, which is connected to the junction conductor 114, and the through hole 172, a ground conductor removal portion 202 in which the ground conductor layers 194, 196, 198 and 200 are removed is provided. By installation of the ground conductor removal portion 202, the distance between the feed connection land 160 and the ground conductor layers 194, 196, 198 and 200 is set larger.

According to a construction like this, the RF signal received by the plane antenna 144 is transmitted to the down converter part 168 by way of the transmission line 176 which is sandwiched and surrounded by the ground pattern 164 and the ground conductor layer 196. Further, although the information display unit 191, such as a liquid crystal display (LCD), which is provided on the rear face of the printed circuit base board 108, generates a noise at the time of its operation, the plane antenna 144, the transmission line 176 and the down converter part 168 are shielded by the ground conductor layers 194, 196, 198 and 200 because the ground conductor layers 196, 198 and 200 of plural layers are provided between the information display unit 191 and the transmission line 176. As a result, the deterioration of a GPS receiving sensitivity will be prevented because a noise does not mix. Further, since the ground conductor removal portion 202 is provided in the down side of the feed connection land 160, which is connected to the junction conductor 114, and the through hole 172, the distance between the feed connection land 160 and the ground conductor layers 194, 196, 198 and 200 can be made larger. By this, the parasitic capacity can be reduced, and the deterioration of an antenna performance can be prevented. In this embodiment, by setting the ground conductor removal portion 202, the inter-electrode distance is enlarged in proportion to the number of removals of the ground conductor layers. Since in this embodiment three conductor layers of the ground conductor layers 196, 198 and 200 are removed, the parasitic capacity is reduced to about ⅓. As a result, the deterioration of an antenna performance due to reduction of the VSWR of the plane antenna 144 can be prevented.

(Eleventh Embodiment)

Figure 29:
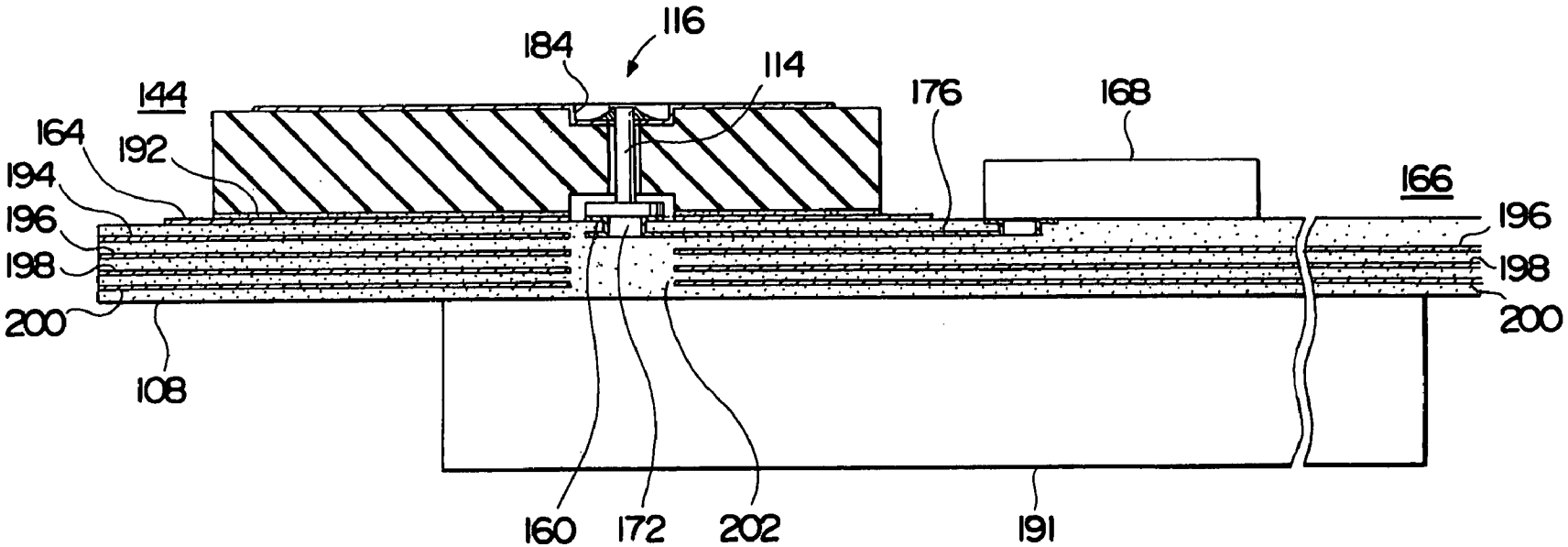
FIG. 29 is a sectional view showing a mounting portion of a plane antenna of a GPS receiving module according to an eleventh embodiment of the present invention.

Next, an antenna element, a plane antenna and a construction of mounting thereof according to an eleventh embodiment of the present invention are explained by referring to FIG. 29. FIG. 29 is a drawing showing a mounting portion of a plane antenna of a GPS receiving module.

This embodiment is the mounting portion of the plane antenna 144 of the GPS receiving module 166 installed in a mobile phone unit and so on, and is constructed by using the plane antenna 144 shown in FIG. 25. That is, the recess portion 184 for a solder connection is formed at the feeding point 116 of the dielectric substrate 100 of the plane antenna 144, and the antenna pattern part 102 extended to the inside of the recess portion 184 is formed. Further, the total length "a" of the junction conductor 114 is set to the length equal to the thickness "f" of the dielectric substrate 100 or less than the thickness "f" ($a \leqq f$), and thereby this embodiment is constructed so that the junction conductor 114 and the antenna pattern part 102 are united within the pointed end portion of the junction conductor 114 not exceeding the thickness of the dielectric substrate 100, namely, within the upper face of the dielectric substrate 100.

According to a construction like this, since the pointed end portion of the junction conductor 114 does not protrude from the plane antenna 144, it is possible to provide the plane antenna 144 close to an inner wall face of a housing case of a mobile phone unit, and this embodiment, therefore, contributes to the flatting of a mobile phone unit.

(Twelfth Embodiment)

Figure 30:
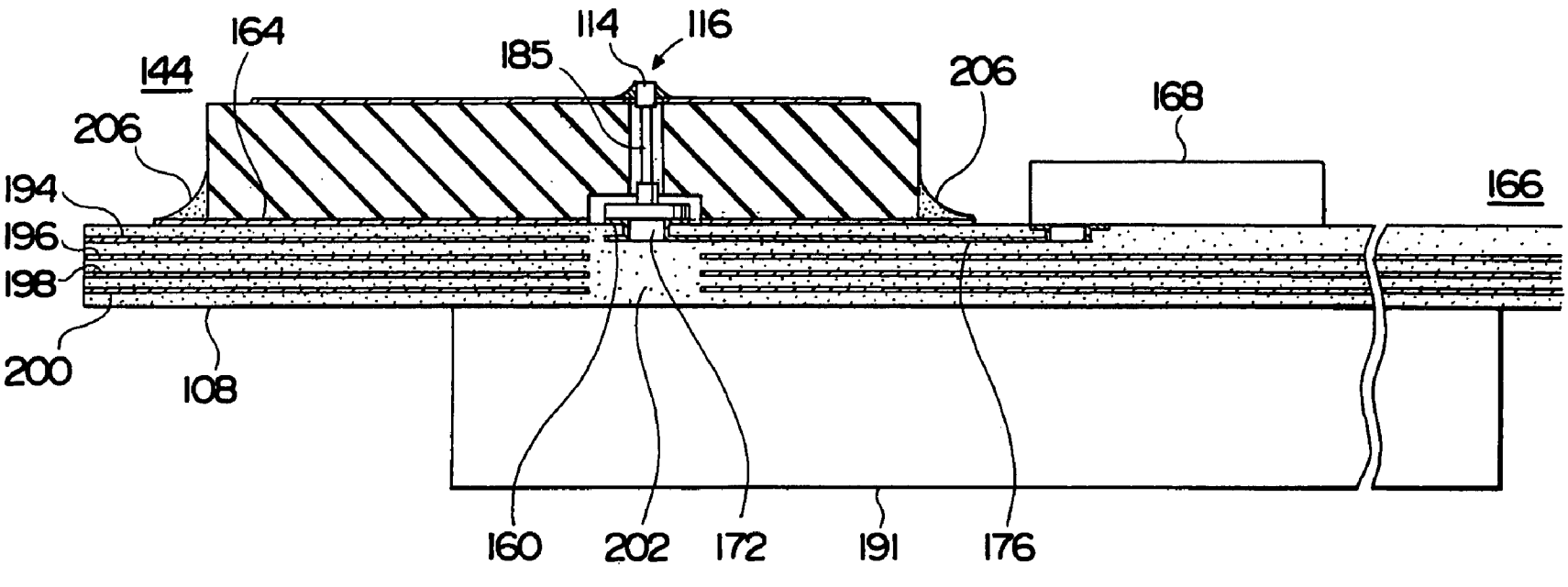
FIG. 30 is a sectional view showing a mounting portion of a plane antenna of a GPS receiving module according to a twelfth embodiment of the present invention.

Next, an antenna element, a plane antenna and a construction of mounting thereof according to a twelfth embodiment of the present invention are explained by referring to FIG. 30. FIG. 30 is a drawing showing a mounting portion of a plane antenna of a GPS receiving module.

This embodiment is the mounting portion of the plane antenna 144 of the GPS receiving module 166 installed in a mobile phone unit and so on, and is constructed by using the plane antenna 144 shown in FIG. 26. Along with this, in this embodiment, the dielectric substrate 100 is installed so as to adhere closely to the ground pattern 164 of the printed circuit base board 108, and is fixed on the printed circuit base board 108 by using an adhesive material 206.

According to a construction like this, as described before, when the flexure of the printed circuit base board 108 occurs by having sudden stress, and/or when stress is given to the junction conductor 114 by the self-weight of the plane antenna 144, for example, by a fall of the mobile phone unit which is a device having the plane antenna 144, the stress and an impact can be absorbed by the small diameter portion 185 of the junction conductor 114. Hence, the disconnection between the feed connection land 160 and the conductor of the side of the through hole 172 can be prevented. Further, since the plane antenna 144 is fixed on the printed circuit base board 108 by the adhesive material 206, the fixing strength of the plane antenna 144 is increased, and it can be prevented that the plane antenna 144 comes off from the printed circuit base board 108.

In this embodiment, the construction in which the plane antenna 144 providing the junction conductor 114 with the small diameter portion 185 is fixed by the adhesive material 206 is described as an example. However, the fixing by the adhesive material 206 can also be applied to the plane antenna 144 according to the fist to eleventh embodiments, and is not limited to the twelfth embodiment.

(Thirteenth Embodiment)

Figure 31:
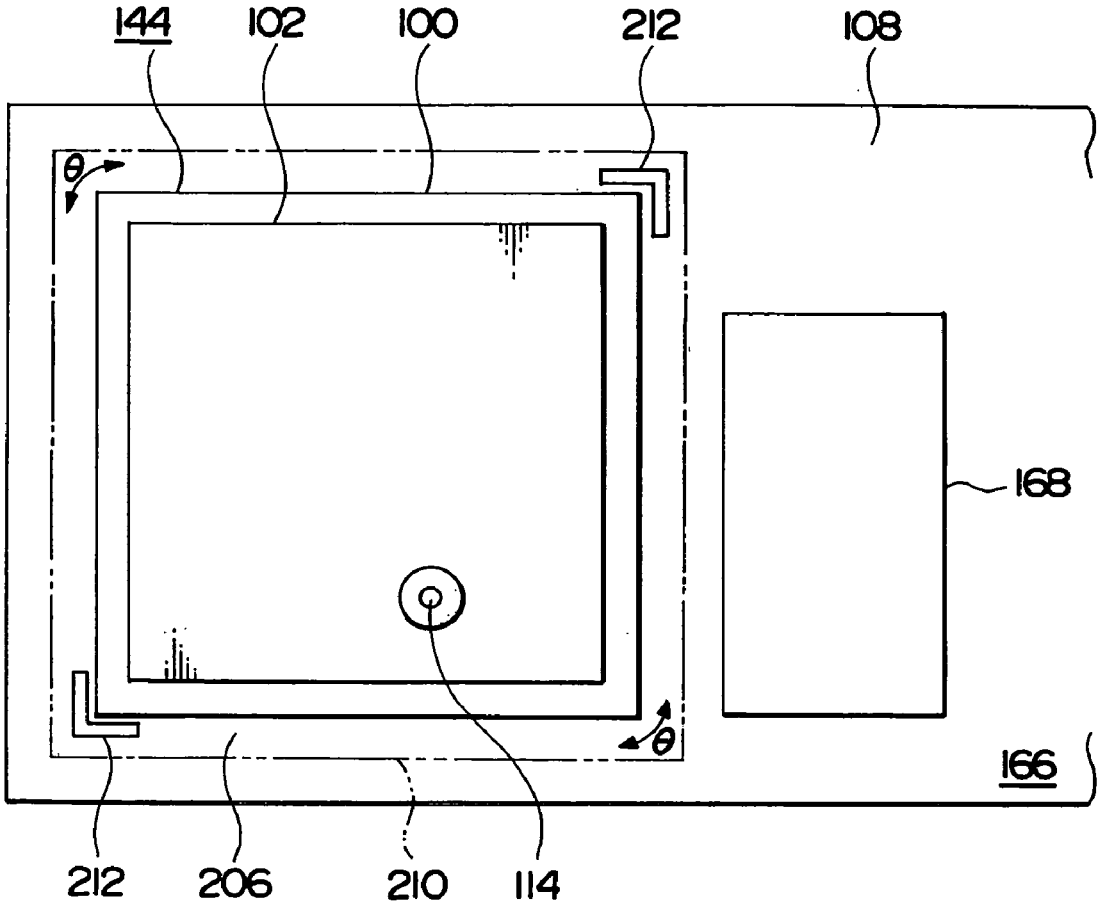
FIG. 31 is a plan view showing a mounting portion of a plane antenna of a GPS receiving module according to a thirteenth embodiment of the present invention.

Next, an antenna element, a plane antenna and a construction of mounting thereof according to a thirteenth embodiment of the present invention are explained by referring to FIG. 31. FIG. 31 is a plan view showing a mounting portion of a plane antenna of a GPS receiving module.

In this embodiment, a mounting part 210 for the plane antenna 144 is set to the printed circuit base board 108 which constructs the GPS receiving module 166 installed in a mobile phone unit and so on, and a positioning mark 212 for mounting of the plane antenna 144 are provided on the mounting part 210 by printing and so on. In this embodiment, since the dielectric substrate 100 of the plane antenna 144 is a square, the positioning mark 212 for mounting is L-shaped indication so as to match with a shape of a corner portion of the dielectric substrate 100, positioning mark 212 is formed at two portions on a diagonal line of the dielectric substrate 100. This positioning mark 212 for mounting is formed so as to match with a shape of the dielectric substrate 100, and, for example, may also be formed so as to surround the dielectric substrate 100.

According to a construction like this, on the basis of the positioning mark 212 for mounting shown in the printed circuit base board 108, the plane antenna 144 is attached on the printed circuit base board 108 and its positioning is performed, and the plane antenna 144 can be fixed at a proper position by spreading the adhesive material 206. In this case, the plane antenna 144 may also be fixed on the printed circuit base board 108 by using the double adhesive tape 192. Like this, if the positioning mark 212 for mounting is provided, the dielectric substrate 100 of the plane antenna 144 revolves around the junction conductor 114 as a center when attaching the plane antenna 144 to the printed circuit base board 108 by hand work. Therefore, an impropriety that a mounted angle e displaces can be avoided, the dispersion of an angle can be suppressed, and the deterioration of an antenna performance due to inclination can be suppressed.

(Fourteenth Embodiment)

Figure 32:
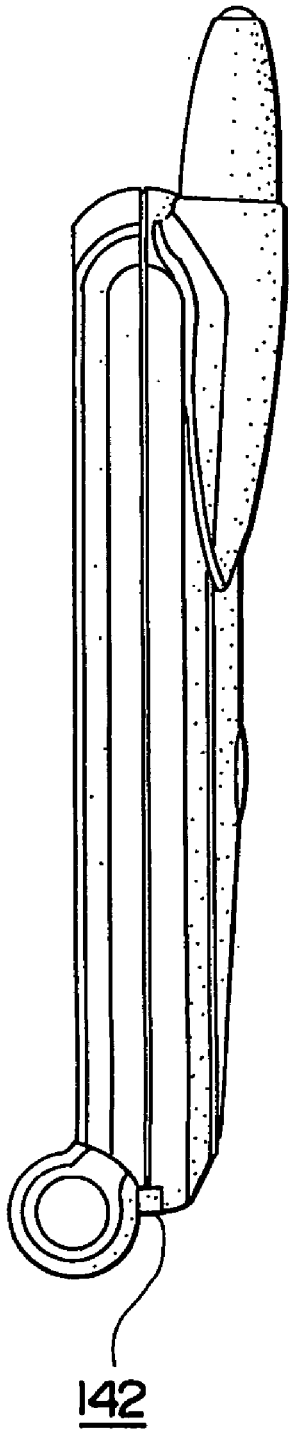
FIG. 32 is a side view showing a mobile terminal according to a fourteenth embodiment of the present invention.
Figure 33:
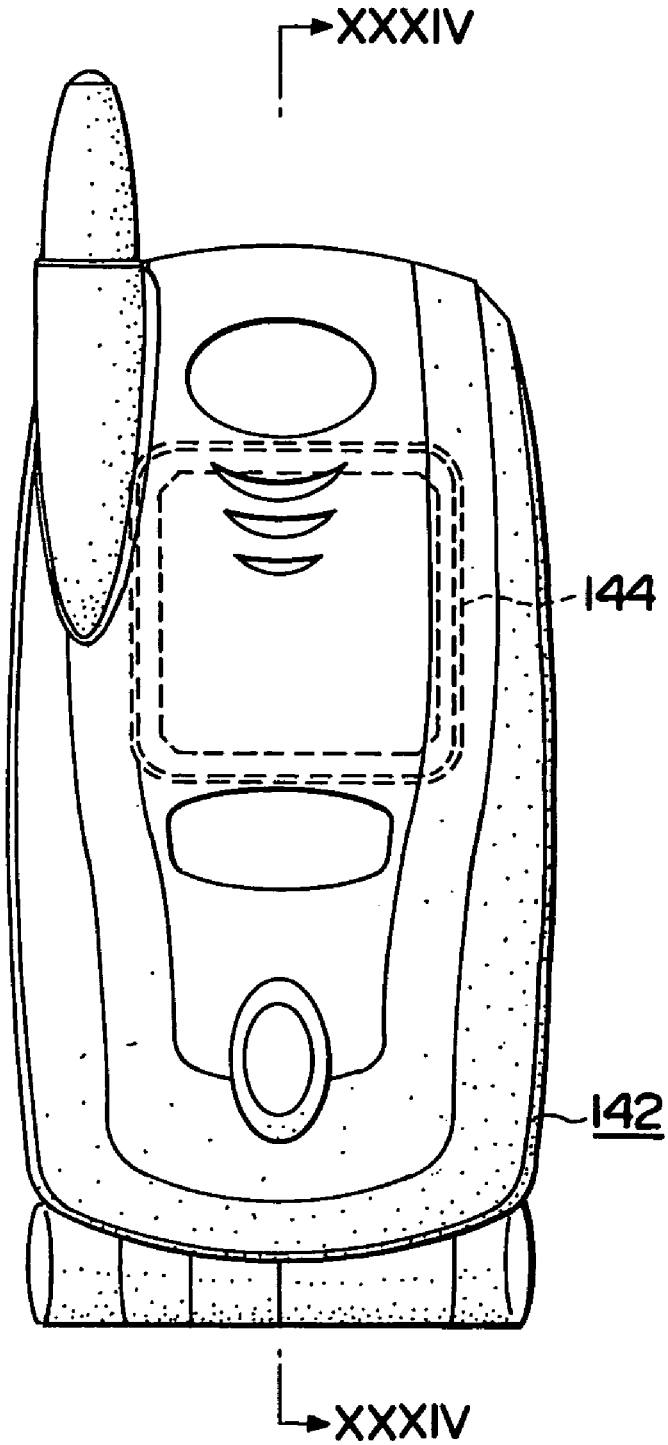
FIG. 33 is a rear view showing the mobile terminal.
Figure 34:
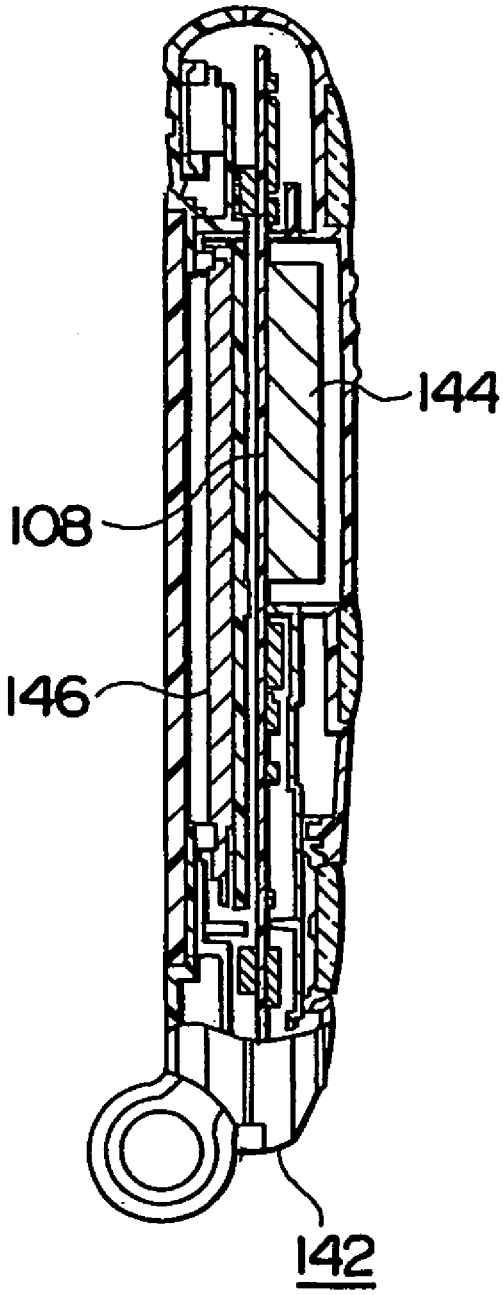
FIG. 34 is a sectional view taken along line XXXIV—XXXIV of the mobile terminal shown in FIG. 33.
Figure 35:
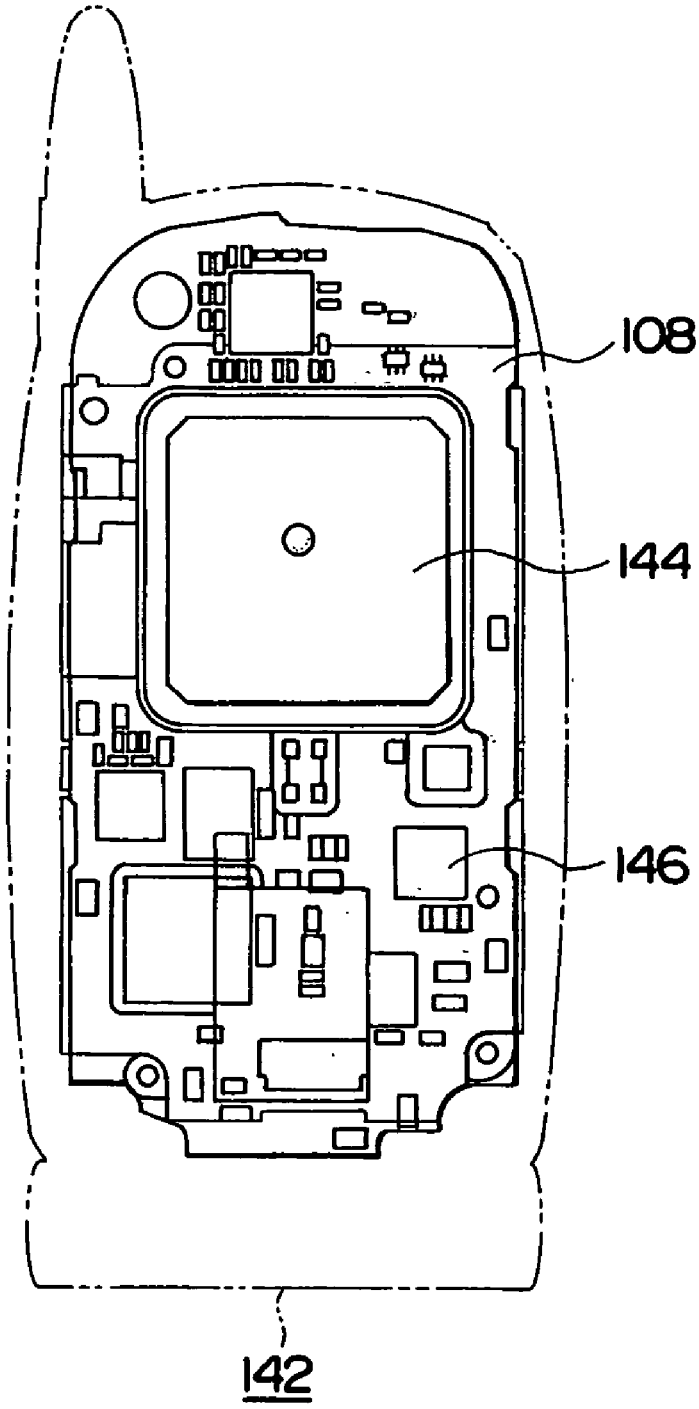
FIG. 35 is a drawing showing a mounting shape on a printed circuit base board in the mobile terminal.

Next, an electronic device according to an fourteenth embodiment of the present invention is explained by referring to FIG. 32, FIG. 33, FIG. 34 and FIG. 35. FIG. 32 is a side view showing a mobile terminal as the electronic device according to the fourteenth embodiment, FIG. 33 is a rear view showing the mobile terminal, FIG. 34 is a sectional view taken along line XXXIV—XXXIV of the mobile terminal shown in FIG. 33, and FIG. 35 is a drawing showing a construction on a circuit base board of the mobile terminal.

This embodiment shows a mobile terminal 142 of a GPS and so on as an electronic device of the present invention, and the plane antenna 144 according to the present invention is mounted on the printed circuit base board 108 and at its rear face portion another component 146 is mounted.

In the mobile terminal 142 using the plane antenna 144 of a construction like this, by excellent functions which the plane antenna 144 according to the present invention has, the mounting density of components is heightened. Along with this, miniaturization, the improvement of an SN ratio dueing to shielding, and the improvement of reliability will be given.

Next, by extracting technical matters from the embodiments of the antenna element, the method of mounting thereof, the plane antenna, the construction of the plane antenna, the method of mounting thereof, the circuit base board on which the plane antenna is mounted, and the communication device having the plane antenna, descrived above, the technical significance of these, the modified examples of these, the technical expanded matters of these, and so on are enumerated in the following.

(1) In the embodiments mentioned above, the GPS receiving antenna is explained as an example. However, the antenna element, the plane antenna and the circuit base board of the present invention can also be applied to a mobile phone unit, a GPS receiving module, a PDA (Personal Digital Assistant) PC and a navigation system using the GPS receiving module, other communication devices, an information processing device, and a radio communication system. That is, the present invention is not limited to the above-mentioned embodiments.

(2) In the embodiments mentioned above, the ground pattern part 110 is provided at the side of the printed circuit base board 108. However, a ground pattern part is provided at the bottom face side of the dielectric substrate 100, and the dielectric substrate 100 may also be installed at the upper face portion of the printed circuit base board 108 through that ground pattern part.

(3) Although in the above-mentioned embodiments the ground pattern part 110 is provided on the upper face of the printed circuit base board 108, a ground pattern part may also be provided in the inner layer portion of the printed circuit base board 108. Further, the feeding conductor connected to the junction conductor 114 may also use a feeding pattern part provided on the surface of the printed circuit base board 108 instead of the feeding pattern part 120 which is an inner layer conductor of the printed circuit base board 108. In this case, this feeding pattern part may be insulated from the ground pattern part 110.

(4) Although in the above-mentioned embodiments a multilayer substrate is used as the printed circuit base board 108, the present invention is not limited to a multilayer substrate of this kind. Also, the circuit base board is not limited to a printed circuit base board.

(5) In the embodiments mentioned above, an example in which the dielectric substrate 100 is constructed by the fired substance of ceramics and so on is explained. However, it may also be constructed by synthetic resin and so on.

(6) Although in the above-mentioned embodiments a bar-shaped metal is used in the junction conductor 114, it may also be constructed as a body with the dielectric substrate 100. Further, although the flange portion 126 is formed in the junction conductor 114, the junction conductor 114 which is composed of only the pillar portion 124 without having the flange portion 126 may also be used.

(7) In the embodiments mentioned above, the double adhesive tape 112 or 192 and the adhesive material 206 are used as adhering means of the antenna element 138A and 138B. However, a fixing member of a screw and so on may also be used instead of the double adhesive tape 112 or 192 and the adhesive material 206. Further, the adhesive material 206 is spread on the lower face side of the dielectric substrate 100 like the double adhesive tape 112 or 192, and the dielectric substrate 100 may also be glued to the printed circuit base board 108.

(8) Although in the above-mentioned embodiments the ground pattern parts 110, 140 and 148 and the ground conductor layers 194, 196, 198 and 200 which are conductive materials formed in the printed circuit base board 108 and 150 as shielding means are used, a metal plate may also be provided on the rear face portion of the printed circuit base board 108.

Although the best mode for carrying out the invention, the object, the configuration and the operation and effect have been described in detail above, the invention is not limited to such embodiment for carrying out the invention, and it is a matter of course that the invention can be variously changed or modified by a person skilled in the art on the basis of a gist and split of the invention as disclosed in claims and the detailed description of the invention, and such a change or modification, and various conjectured configurations, modified examples and so forth are included in the scope of the invention, and the description of the specification and drawings are not restrictively understood.

The entire disclosure of Japanese Patent

Applications No. 2003-028902 and 2003-287783 including specification, claims, drawings and summary are incorporated herein by reference in their entirety.

What is claimed is:

1. An antenna element which is mounted on a circuit base board, comprising:

a dielectric substrate having an antenna pattern part; and a junction conductor piercing said dielectric substrate, having its one end connected to a feeding point of said antenna pattern part, wherein said junction conductor has a pillar portion piercing said dielectric substrate and a flange portion formed at the other end of the pillar portion;

said dielectric substrate includes a through hole for letting the pillar portion of said junction conductor pierce therein and a space portion for housing said flange portion, which is provided adjoining to the through hole; and the end portion of said pillar portion of said junction conductor is connected to said feeding point of said antenna pattern part, and said flange portion is connected to a feeding conductor on said circuit base board on the side on which said antenna element is mounted.

2. The antenna element of claim 1, wherein said circuit base board further includes said feeding conductor covered with an insulator and a recess portion exposing said feeding conductor to the same side on which said antenna element is mounted, and said flange portion on said space portion side of said junction conductor in said dielectric substrate is connected to said feeding conductor exposed in said recess portion.

3. The antenna element of claim 1, wherein said pillar potion is set more thinly than thickness of said flange portion.

4. The antenna element of claim 1, wherein said circuit base board and said dielectric substrate are fixed by an elastically adhesive material.

5. The antenna element of claim 4, wherein said elastically adhesive material is a resin tape having adhesive layers at both faces.

6. An antenna element which is mounted on a circuit base board, comprising:

a dielectric substrate having an antenna pattern part; and a junction conductor disposed between said antenna pattern part and said circuit base board, wherein said dielectric substrate includes a recess portion in which a feeding point of said antenna pattern part is disposed, and wherein said junction conductor pierces said dielectric substrate, having its one end connected to the feeding point of said antenna pattern part in said recess portion of said dielectric substrate, and having its other end connected to a feeding conductor on said circuit base board on the side on which said antenna element is mounted.

7. An antenna element which is mounted on a circuit base board, comprising:

a dielectric substrate having an antenna pattern part; and a junction conductor disposed between said antenna pattern part and said circuit base board, wherein said dielectric substrate includes a through hole corresponding to a feeding point of said antenna pattern part and a recess portion formed at an opening portion of said through hole; and wherein said junction conductor pierces said through hole of said dielectric substrate and stands on said circuit base board as well, having its one end portion connected to a feeding conductor of said circuit base board and having its other end portion connected to said feeding point of said antenna pattern part.

8. An antenna element which is mounted on a circuit base board, comprising:

a dielectric substrate having an antenna pattern part; and a junction conductor disposed between said antenna pattern part and said circuit base board, wherein said dielectric substrate includes a through hole corresponding to a feeding point of said antenna pattern part and a recess portion formed at an opening portion of said through hole; and wherein said junction conductor pierces said through hole, having its one end portion connected to said feeding point of said antenna pattern part and having its other end portion faced toward said recess portion.

9. An antenna element which is mounted on a circuit base board, comprising:

a dielectric substrate having an antenna pattern part; and a junction conductor piercing said dielectric substrate, having its one end connected to a feeding point of said antenna pattern part, wherein said junction conductor has a pillar portion piercing said through hole of said dielectric substrate to be connected to the feeding point of said antenna pattern part and a flange portion formed at the pillar portion;

wherein said flange portion of said junction conductor is connected to a feeding conductor on said circuit base board on the side on which said antenna element is mounted, and wherein said flange portion of said junction conductor is set larger than said through hole of said dielectric substrate and smaller than a recess portion formed at an opening portion of said through hole.

10. Amounting method of an antenna element, comprising:

a process that forms an antenna element, which provides an antenna pattern part and a through hole corresponding to a feeding point of said antenna pattern part, in a dielectric substrate;

a process that connects a flange portion of a junction conductor formed of a pillar portion and the flange portion to a feeding conductor on a circuit base board side, and that makes said junction conductor stand on said circuit base board;

a process that lets said junction conductor pierce said through hole of said antenna element, and that connects an end portion of said pillar portion of said junction conductor to said feeding point of said antenna pattern part; and a process that bonds said circuit base board and said dielectric substrate by interposing an elastically adhesive material between them.

11. A mounting method of an antenna element, comprising:

a process that forms an antenna element providing a dielectric substrate having an antenna pattern part; and a junction conductor disposed between said antenna pattern part and a feeding conductor on a circuit base board; wherein said junction conductor has a pillar portion piercing said dielectric substrate and a flange portion formed at the other end of the pillar portion; wherein said dielectric substrate includes a through hole for letting the pillar portion of said junction conductor pierce therein and a space portion for housing said flange portion, which is provided adjoining to the through hole; and wherein an end portion of said pillar portion is connected to said antenna pattern part; and a process that bonds said antenna element to said circuit base board by using an elastically adhesive material, and that connects said flange portion of said junction conductor to the feeding conductor on said circuit base board.

12. A plane antenna providing an antenna element which is mounted on a circuit base board, comprising:

a dielectric substrate having an antenna pattern part;

a junction conductor including a first ground pattern part interposed between said dielectric substrate and said circuit base board, a pillar portion piercing said dielectric substrate, and a flange portion formed at the pillar portion, wherein an end portion of said pillar portion is connected to a feeding point of said antenna pattern part formed on said dielectric substrate, and wherein said flange portion faces toward a space portion formed between said dielectric substrate and said circuit base board;

a feeding conductor, being led to said space portion from an inner layer portion of said circuit base board to be connected to said flange portion of said junction conductor; and a second ground pattern part made of conductor layers disposed on a lower face side of said feeding conductor, wherein a conductor removal part that has removed said conductor layers adjacent to a connecting portion of said junction conductor and said feeding conductor is set.

13. The plane antenna of claim 12, wherein said circuit base board and said dielectric substrate are fixed by an elastically adhesive material.

14. The plane antenna of claim 13, wherein said elastically adhesive material is a resin tape having adhesive layers at both faces.

15. The plane antenna of claim 12, wherein a first ground pattern part is provided on an upper face side of said circuit base board, and an insulating substrate or a shielding plate having a second ground pattern part is provided to a rear face side of said circuit base board.

16. A circuit base board on which a plane antenna providing an antenna pattern part in a dielectric substrate is mounted, comprising:

a junction conductor providing a flange portion;

a through hole formed in said dielectric substrate, said junction conductor being pierced to said through hole; and a recess portion formed at an opening portion of said circuit base board side of said through hole, said recess portion housing said flange portion of said junction conductor, wherein said junction conductor which is attached on said circuit base board in advance is made to pierce to said through hole of said dielectric substrate so that said flange portion is housed in said recess portion of said dielectric substrate, its pointed end portion is connected to said antenna pattern part, and said dielectric substrate and said circuit base board are also installed with close adhesion.

17. An electronic device providing an antenna element which is mounted on a circuit base board, comprising:

a dielectric substrate having an antenna pattern part; and a junction conductor piercing said dielectric substrate, having its one end connected to a feeding point of said antenna pattern part, wherein said junction conductor has a pillar portion piercing said dielectric substrate and a flange portion formed at the other end of the pillar portion;

said dielectric substrate includes a through hole for letting the pillar portion of said junction conductor pierce therein and a space portion for housing said flange portion, which is provided adjoining to the through hole; and the end portion of said pillar portion of said junction conductor is connected to said feeding point of said antenna pattern part, and said flange portion is connected to a feeding conductor on said circuit base board on the side on which said antenna element is mounted.

18. The electronic device of claim 17, wherein said circuit base board further includes said feeding conductor covered with an insulator and a recess portion exposing said feeding conductor to the same side on which said antenna element is mounted; and wherein said flange portion of said junction conductor on said space portion side of said dielectric substrate is connected to said feeding conductor exposed in said recess portion.

19. The electronic device of claim 17, wherein said pillar potion is set more thinly than thickness of said flange portion.

20. The electronic device of claim 17, wherein said circuit base board and said dielectric substrate are fixed by an elastically adhesive material.

21. The electronic device of claim 20, wherein said elastically adhesive material is a resin tape having adhesive layers at both faces.

22. An electronic device providing an antenna element which is mounted on a circuit base board, comprising:

a dielectric substrate having an antenna pattern part; and a junction conductor disposed between said antenna pattern part and said circuit base board, wherein said dielectric substrate includes a recess portion in which a feeding point of said antenna pattern part is disposed; and wherein said junction conductor pierces said dielectric substrate, having its one end connected to the feeding point of said antenna pattern part in said recess portion of said dielectric substrate, and having its other end connected to a feeding conductor on said circuit base board on the side on which said antenna element is mounted.

23. An electronic device providing an antenna element which is mounted on a circuit base board, comprising:

a dielectric substrate having an antenna pattern part; and a junction conductor disposed between said antenna pattern part and said circuit base board, wherein said dielectric substrate includes a through hole corresponding to a feeding point of said antenna pattern part and a recess portion formed at an opening portion of said through hole; and wherein said junction conductor pierces said through hole of said dielectric substrate and stands on said circuit base board as well, having its one end portion connected to a feeding conductor of said circuit base board and having its other end portion connected to said feeding point of said antenna pattern part.

24. An electronic device providing an antenna element which is mounted on a circuit base board, comprising:

a dielectric substrate having an antenna pattern part; and a junction conductor disposed between said antenna pattern part and said circuit base board, wherein said dielectric substrate includes a through hole corresponding to a feeding point of said antenna pattern part and a recess portion formed at an opening portion of said through hole; and wherein said junction conductor pierces said through hole, having its one end portion connected to said feeding point of said antenna pattern part and having its other end portion faced toward said recess portion.

25. An electronic device providing an antenna element which is mounted on a circuit base board, comprising:

a dielectric substrate having an antenna pattern part; and a junction conductor Piercing said dielectric substrate, having its one end connected to a feeding point of said antenna pattern part, wherein said junction conductor has a pillar portion piercing said through hole of said dielectric substrate to be connected to the feeding point of said antenna pattern part and a flange portion formed at the pillar portion;

wherein said flange portion of said junction conductor is connected to a feeding conductor on said circuit base board on the side on which said antenna element is mounted; and wherein said flange portion of said junction conductor is set larger than said through hole of said dielectric substrate and smaller than a recess portion formed at an opening portion of said through hole.

26. An electronic device providing a plane antenna which is mounted on a circuit base board, comprising:

a dielectric substrate having an antenna pattern part;

a junction conductor including a first ground pattern part interposed between said dielectric substrate and said circuit base board, a pillar portion piercing said dielectric substrate, and a flange portion formed at the pillar portion, wherein an end portion of said pillar portion is connected to a feeding point of said antenna pattern part formed on said dielectric substrate, and wherein said flange portion faces toward a space portion formed between said dielectric substrate and said circuit base board;

a feeding conductor, being led to said space portion from an inner layer portion of said circuit base to be connected to said flange portion of said junction conductor; and a second ground pattern part made of conductor layers disposed on a lower face side of said feeding conductor, wherein a conductor removal part that has removed said conductor layers adjacent to a connecting portion of said junction conductor and said feeding conductor is set.

27. The electronic device of claim 26, wherein said circuit base board and said dielectric substrate are fixed by an elastically adhesive material.

28. The electronic device of claim 27, wherein said elastically adhesive material is a resin tape having adhesive layers at both faces.

29. The electronic device of claim 26, wherein a first ground pattern part is provided on an upper face side of said circuit base board, and an insulating substrate or a shielding plate having a second ground pattern part is provided to a rear face side of said circuit base board.

30. An electronic device comprising:

a circuit base board on which a plane antenna providing an antenna pattern part in a dielectric substrate is mounted;

a junction conductor providing a flange portion;

a through hole formed in said dielectric substrate, said junction conductor being pierced to said through hole; and a recess portion formed at an opening portion of said circuit base board side of said through hole, said recess portion housing said flange portion of said junction conductor, wherein said junction conductor which is attached on said circuit base board in advance is made to pierce to said through hole of said dielectric substrate so that said flange portion is housed in said recess portion of said dielectric substrate, its pointed end portion is connected to said antenna pattern part, and said dielectric substrate and said circuit base board are also installed with close adhesion.

* * * * *

UNITED STATES PATENT AND TRADEMARK OFFICE

CERTIFICATE OF CORRECTION

PATENT NO. : 7,009,563 B2
APPLICATION NO. : 10/766963
DATED : March 7, 2006
INVENTOR(S) : Shinichiro Mori et al.

It is certified that error appears in the above-identified patent and that said Letters Patent is hereby corrected as shown below:

Column 28, Line 47, change “Piercing” to --piercing--.

Signed and Sealed this

Third Day of April, 2007

JON W. DUDAS
*Director of the United States Patent and Trademark Office*